US006501455B1

(12) United States Patent
Nakamura

(10) Patent No.: US 6,501,455 B1
(45) Date of Patent: Dec. 31, 2002

(54) DRIVING DEVICE AND DRIVING METHOD OF LIQUID CRYSTAL DISPLAY DEVICE

(75) Inventor: Toshihiro Nakamura, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/349,932

(22) Filed: Jul. 8, 1999

(30) Foreign Application Priority Data

Jul. 14, 1998 (JP) ..... 10-199241

(51) Int. Cl.[7] ..... G09G 3/36

(52) U.S. Cl. ..... 345/96; 345/87; 345/92; 345/94

(58) Field of Search ..... 345/87, 92, 94, 345/96, 99, 211, 212, 213

(56) References Cited

U.S. PATENT DOCUMENTS

| | | | | | |
|---|---|---|---|---|---|
| 5,731,798 | A | * | 3/1998 | Shin | 345/99 |
| 5,754,152 | A | | 5/1998 | Nakamura | |
| 5,781,185 | A | * | 7/1998 | Shin | 345/213 |
| 5,863,458 | A | * | 1/1999 | Miyata et al. | 345/87 |
| 5,886,678 | A | * | 3/1999 | Katakura et al. | 345/94 |
| 5,900,852 | A | * | 5/1999 | Tanaka et al. | 345/87 |
| 5,940,061 | A | * | 8/1999 | Sato | 345/99 |
| 5,966,119 | A | * | 10/1999 | Hwang | 345/213 |
| 6,011,533 | A | * | 1/2000 | Aoki | 345/92 |
| 6,040,828 | A | * | 3/2000 | Park | 345/213 |

FOREIGN PATENT DOCUMENTS

| | | |
|---|---|---|
| JP | 5265402 | 10/1993 |
| JP | 6012030 | 1/1994 |
| JP | 06-019428 | 1/1994 |
| JP | 10116056 | 5/1998 |

* cited by examiner

*Primary Examiner*—Richard Hjerpe
*Assistant Examiner*—Kimnhung Nguyen
(74) *Attorney, Agent, or Firm*—Birch, Stewart, Kolasch & Birch

(57) ABSTRACT

A driving device of a liquid crystal display device includes a liquid crystal panel which is provided with a group of segment electrodes and a group of common electrodes disposed to intersect with the group of segment electrodes and a liquid crystal sandwitched therebetween. The driving device includes a controller which controls a changing period for changing an output level of a segment driving signal which drives the group of segment electrodes in a single scanning period, within a voltage level which is the same polarity with respect to a common driving output which drives the group of common electrodes. The driving device corrects a driving voltage error generated by a change in display data and alternating signal by controlling the changing period. As a result, the driving device improves the display quality of the liquid crystal panel.

21 Claims, 20 Drawing Sheets

DRIVING DEVICE AND DRIVING METHOD OF LIQUID CRYSTAL DISPLAY DEVICE

FIELD OF THE INVENTION

The present invention relates to a driving device and driving method of a liquid crystal display device for improving display quality of a liquid crystal display device of a simple matrix type.

BACKGROUND OF THE INVENTION

In a conventional liquid crystal display device of a simple matrix type, as shown in FIG. 10, a segment side driving circuit (segment driver) 72 and a common side driving circuit (common driver) 73 are connected to a liquid crystal panel 71. To the segment side driving circuit 72 and the common side driving circuit 73 are connected a power source circuit 74 and a controller 75. The power source circuit 74 supplies power to the segment side driving circuit 72 and the common side driving circuit 73. The controller 75 sends various control signals to the segment side driving circuit 72 and the common side driving circuit 73.

The controller 75 gives the segment side driving circuit 72 display data, a data latch clock for taking in the display data, a horizontal synchronizing signal, and an alternating signal for driving the liquid crystal panel 71 in AC. The controller 75 gives the common side driving circuit 73 a horizontal synchronizing signal, an alternating signal, and a vertical synchronizing signal for recognizing a start of a screen.

The power source circuit 74 supplies voltages of $V_{BH}$ and $V_{BL}$ to the segment side driving circuit 72, and voltages of $V_H$, $V_C$, and $V_L$ to the common side driving circuit 73. The liquid crystal panel 71 constitutes a simple matrix arrangement by segment electrodes $X_1$, $X_2$, $X_3$, . . . , and $X_m$ and common electrodes $Y_1$, $Y_2$, $Y_3$, . . . , and $Y_n$, and a liquid crystal cell 76 constitutes a pixel at the intersection of the segment electrodes and the common electrodes.

FIG. 11 shows an internal structure of the conventional segment side driving circuit 72. The segment side driving circuit 72 includes a shift register 77, a data latch 78, a line latch 79, a level shifter 80, and a liquid crystal driving output circuit 81. In the case where the segment side driving circuit 72 has, for example, 240 outputs, the display data of 240 lines are serially inputted to the shift register 77 in synchronization with the data latch clock. The display data then are converted into parallel data in the shift register 77, and are latched in the data latch 78 and accumulated therein.

When data of the number of column electrodes of the liquid crystal panel 71 are accumulated, the horizontal synchronizing signal (LP) is inputted, and the display data accumulated are latched by the line latch 79. The display data then are converted by the level shifter 80 from a logic voltage level to a liquid crystal driving voltage level to be inputted to the liquid crystal driving output circuit 81. The liquid crystal driving output circuit 81 outputs a driving output voltage to the segment electrodes $X_1$, . . . , and $X_{240}$ of the liquid crystal panel 71 in accordance with the display data inputted from the level shifter 80 and in accordance with the alternating signal (FR).

FIG. 12 shows operations of the prior art. For convenience, the explanation will be given through the case where the number of common electrodes Y (scanning electrodes) is, for example, seven, that is, the case where the alternating signal is switched per seven scanning periods.

A common output voltage $V_Y$ applied to the common electrodes Y as scanning electrodes receives the vertical synchronizing signal and outputs, in accordance with the horizontal synchronizing signal and the alternating signal from a head line, either $V_H$ level or $V_L$ level when the electrodes are selected, and outputs $V_C$ level when the electrodes are not selected (non-select period). A segment output voltage $V_X$ applied to the segment electrodes X as data electrodes is selected as one of $V_{BH}$ and $V_{BL}$ levels in accordance with the display data and the alternating signal, and the whole output of a single scanning electrode is applied in parallel to the segment electrodes X.

In the liquid crystal panel 71, a potential difference between the segment electrodes X and the common electrodes Y is applied to each pixel, and display or non-display is decided in accordance with an effective value of the potential difference in a single frame period, which is the time required to display one screen. In the prior art, the display color or gradation on the liquid crystal panel 71 is slightly different depending on display data or display pattern even by comparison within the same ON display or OFF display.

The following describes one example of luminous non-uniformity generated by display data.

① As shown in FIG. 13, in the case of a whole screen ON display, the segment output voltage from each segment side driving circuit 72 is maintained at a constant voltage level unless the alternating signal is changed.

The effective voltage $V_{effA}$ of voltage $V_A$ applied to the liquid crystal cell 76 as a pixel of the liquid crystal panel 71 is represented by a difference between a potential of a segment output waveform and a potential of a common output waveform.

② As shown in FIG. 14, in the case of a stripe display in which display data repeats ON and OFF per scanning line, the segment output voltage from each segment side driving circuit 72 is outputted with alternating and repeating $V_{BH}$ and $V_{BL}$ levels per fall of the horizontal synchronizing signal even when the alternating signal is not changed.

The effective voltage $V_{effB}$ of voltage $V_B$ applied to the liquid crystal cell 76 as a pixel of the liquid crystal panel 71 is represented by a difference between a potential of a segment output waveform and a potential of a common output waveform.

The difference between ① and ② is that the number of changes of the output level of the segment output waveform per unit time is different. When the output level changes, the output waveform is blunted by such factors as the capacitance of the liquid crystal cell 76, the electrode resistance of the electrodes of the liquid crystal panel 71, and the output resistance of the driving circuits 72 and 73, and therefore when the number of changes of the output level is large, the effective voltage is reduced by blunted waveform.

Thus, even when there are the same numbers of ON display pixels and OFF display pixels, the effective voltage $V_{effB}$, in which the number of changes of the output level of the segment output waveform is made larger, satisfies the relationship of $V_{effB} < V_{effA}$ relative to the effective voltage $V_{effA}$. As a result, by this reduction in effective voltage, luminous non-uniformity called shadowing is generated on the display screen.

The following describes an example of luminous non-uniformity generated when the alternating signal is switched.

③ As shown in FIG. 15, in the case of a whole screen ON display in which the alternating signal is switched at least once in a single frame period, the segment output voltage from the segment side driving circuit 72 is outputted with alternating and repeating $V_{BH}$ and $V_{BL}$ levels in accordance with the alternating signal. When the alternating signal is switched, all the segment output voltages are switched at once from (a) $V_{BH}$ to $V_{BL}$ or from (b) $V_{BL}$ to $V_{BH}$. Here, distortion due to a voltage shift is generated on the common electrodes Y, which are scanning electrodes facing the segment electrodes X with the liquid crystal therebetween, in accordance with the ratio of the change [(a) and (b)] in the segment electrodes X.

The effective voltage $V_{effC}$ of voltage $V_C$ applied to the liquid crystal cell 76 which is a pixel of the liquid crystal panel 71 is represented by a difference between a potential of the segment output waveform and a potential of the common output waveform.

④ As shown in FIG. 16, in the case of a partially OFF block display, as with the case ③, the segment output voltages change all at once, and thus there is generated distortion due to a voltage shift on the common electrodes Y, which are scanning electrodes facing the segment electrodes X with the liquid crystal therebetween, in accordance with the ratio of the change [(a) and (b)] of the segment electrodes X.

The effective voltage $V_{effD}$ of voltage $V_D$ applied to the liquid crystal cell 76 which is a pixel of the liquid crystal panel 71 is represented by a difference between a potential of the segment output waveform and a potential of a common output waveform.

The difference between ③ and ④ is that the directions of distortion generated on the common output waveform with respect to the output level of the segment output waveform are different.

In case ③, the changes in the segment output waveform are all directed in the same direction of the changes of the alternating signal, and for this reason the direction of the segment output waveform and the direction of the distortion generated on the common output waveform are the same, whereas in case ④, the changes in the segment output waveform are directed in the reverse direction of the changes of the alternating signal in the pixels on the segment electrodes X displaying a longitudinal OFF block display, and for this reason the direction of the segment output waveform and the direction of the distortion generated on the common output waveform are different, and the effective voltage of the distorted portion is increased as a result.

Therefore, the effective voltages applied to the liquid crystal cell 76 become different by the ratio of ON-OFF of display data when the alternating signal is changed and by the segment output voltage level. Namely, in case ③ and case ④, $V_{effC}<V_{effD}$, and as a result luminous non-uniformity called shadowing is generated.

For example, Japanese Unexamined Patent Publication No. 265402/1993 (Tokukaihei 5-265402) (published date: Oct. 15, 1993) discloses a technique for reducing luminous non-uniformity of display which is dependent on display pattern, in a liquid crystal display device of a simple matrix type which drives a liquid crystal panel in the described manner.

This technique is a driving method of a liquid crystal display device of a simple matrix type for driving a liquid crystal panel, for example, as shown in FIG. 17. Namely, a correction period is provided per line scanning period with respect to all outputs from a column driving circuit which corresponds to the segment side driving circuit 72. In the correction period, an intermediate voltage level of the ON display voltage level and OFF voltage display level is outputted as a correction voltage, instead of the display voltage outputted from the column driving circuit.

FIG. 17, FIG. 18, and FIG. 19 show common output voltage $V_Y$ and segment output voltage $V_X$ applied to the liquid crystal panel in the technique disclosed in the above publication, in the case of a stripe display, whole screen ON display, and whole screen OFF display, respectively.

In the technique as disclosed in the above publication, the output waveforms of the segment side driving circuit 72 are all changed to an intermediate voltage level of an ON display voltage level and OFF display voltage level per single scanning period regardless of the display pattern. Thus, the number of output changes of the segment side driving circuit 72 becomes the same, thus reducing the display pattern dependent variation in effective value of the applied voltage. As a result, the above technique makes it possible to reduce luminous non-uniformity which is based on blunted waveform in accordance with the changes.

However, in the technique as disclosed in the above publication, an intermediate level is outputted in a correction period, and for this reason, compared with the effective voltage value applied to the liquid crystal cell 76 in a common driving method, the effective voltage value is reduced.

Thus, in the above technique, the contrast is lowered and the display quality suffers by the reduction in effective voltage value. Namely, as shown in FIG. 17, due to the fact that a portion 77 of the effective voltage at which an intermediate voltage level is applied to the segment electrodes X is lost, the effective value $V_{eff}$ of the voltage $(V_X-V_Y)$ applied to the liquid crystal cell is lowered, thus the problem that the display quality is susceptible to deterioration such as lowered contrast.

Japanese Unexamined Patent Publication No. 116056/1998 (Tokukaihei 10-116056) (published date: May 6, 1998), which is the invention of the inventors of the present application, proposes another technique for overcoming the above problem. FIG. 20 shows a common output voltage and segment output voltage applied to the liquid crystal cell of this publication.

In this technique, as the driving method of a liquid crystal display device of a simple matrix type, a display data signal and a display data signal of a preceding scanning period are independently compared per each pixel column, and when the display data signals are the same, a correction period whose period is fixed is provided in a single scanning period.

In this technique, in a correction period, an intermediate voltage level of an ON display voltage level and OFF display voltage level is outputted as a correction voltage, instead of a display voltage outputted from the segment side driving circuit 72.

Namely, when the display voltage level outputted from the segment side driving circuit 72 does not change for not less than two consecutive scanning periods, a voltage loss corresponding to blunted waveform generated when the display voltage level is changed to the ON display voltage level and OFF display voltage level in a correction period is corrected so as to reduce the display pattern dependent variation in the effective value of the applied voltage.

As a result, the above technique minimizes a voltage loss of the effective voltage applied to the liquid crystal cell 76, and solves luminous non-uniformity dependent on display pattern while minimizing lowering of contrast.

Another technique for solving the problem of variation in effective value of an applied voltage due to distortion of the common electrodes generated by a change in segment output waveform, which is another factor of shadowing, is disclosed in Japanese Unexamined Patent Publication No. 12030/1994 (Tokukaihei 6-12030) (published date: Jan. 21, 1994). In this technique, the waveform distortion of the common electrodes Y is detected, and by applying a reverse voltage of the distortion to the common electrodes Y, the variation in the effective value of the applied voltage due to waveform distortion of the common electrodes Y is reduced.

However, in the technique disclosed in the above publication, because the potential of the waveform distortion of the common electrodes Y is small, the mechanism for accurately detecting the waveform distortion becomes complex, and there arises the problem of increased cost due to the complicated mechanism.

The problems such as above are solved by the described technologies, yet the following problems remain to be solved. Namely, the technique disclosed in the above Japanese Unexamined Patent Publication No. 116056/1998 (Tokukaihei 10-116056) does not solve the problem of luminous non-uniformity due to distortion of the common electrodes Y, which is caused by a change in segment output waveform, which is another factor of shadowing. This problem cannot be solved unless this technique is combined with the technique disclosed in the above Japanese Unexamined Patent Publication No. 12030/1994 (Tokukaihei 6-12030). Thus, there remains the conventional problem that it is difficult to prevent deterioration of display quality and to simplify the mechanism at the same time.

SUMMARY OF THE INVENTION

An object of the present invention is to provide a liquid crystal display device and a driving method thereof which can improve display quality of a liquid crystal panel and simplify a system of the liquid crystal display device by eliminating a loss in effective voltage applied to a liquid crystal cell so as to solve luminous non-uniformity which depends on display pattern, and by correcting by a segment side driving circuit distortion of common electrodes generated by a change in segment output waveform.

In order to achieve the above object, a driving device of a liquid crystal display device of the present invention includes: a group of signal electrodes which are driven by a driving signal which corresponds to display data; a group of scanning electrodes which are disposed so as to intersect with the group of signal electrodes; a liquid crystal sandwitched between the group of signal electrodes and the group of scanning electrodes; an alternate control section for alternately and inversely driving the liquid crystal by an alternating signal; and a period control section for setting a changing period for changing an output level of the driving signal at least once in a single scanning period, and for controlling the changing period based on a change in the driving signal and a change in the alternating signal.

With this arrangement, a driving voltage error which is generated by a distortion generated on the group of scanning electrodes by a change in the driving signal of the group of signal electrodes can be corrected on the side of the driving signal of the group of signal electrodes by the control section, which controls the changing period for changing the output level, namely by adjusting the duration of the changing period.

Also, with the above arrangement, a driving voltage error which is generated by blunted waveform, etc., of the driving signal of the group of signal electrodes can also be corrected by comparing the driving signal with respect to the liquid crystal to be driven and the driving signal of the preceding scanning period based on whether they are at ON display level or OFF display level. Namely, when the driving signals compared are different, a voltage loss due to the driving voltage error by the blunted waveform is corrected on the side of the group of signal electrodes by controlling, that is, by adjusting by the control section the changing period for changing the output level.

In this manner, with the above arrangement, (a) the driving voltage error to be a loss of the effective voltage, due to blunted waveform of the driving signal of the group of signal electrodes, and (b) the driving voltage error generated by the distortion generated on the group of scanning electrodes by a change in waveform of the driving signal of the group of signal electrodes can be corrected by controlling the changing period for changing the output level, which is set in the driving signal, in a single scanning period based on a change in the driving signal and a change in the alternating signal, for example, by adjusting the duration of the changing period.

As a result, with the described arrangement, (a) the output waveform of a driving signal which is not to be corrected and (b) the output waveform of a driving signal which is to be corrected can be separately adjusted based on a change in the driving signal and a change in the alternating signal, thus making it possible to further reduce the difference on a display between the output waveform (a) and the output waveform (b). Thus, with the above arrangement, luminous non-uniformity on the display of the liquid crystal display device can be suppressed compared with the case where the period for changing the output level is fixed.

Further, with the above arrangement, the driving voltage error is corrected by predicting the generation of the driving voltage error based on a change in the driving signal and a change in the alternating signal. Thus, the conventional mechanism for detecting and correcting the driving voltage error can be omitted, thus simplifying the mechanism for correction.

As a result, with the above arrangement, by the provision of the control section which controls the changing period for changing the output level of the driving signal in a single scanning period based on a change in the driving signal and a change in the alternating signal, luminous non-uniformity on the display can be suppressed and the mechanism can be simplified.

In order to achieve the above object, another driving device of a liquid crystal display device of the present invention further includes a power source circuit for supplying (a) $V_C$ which is a non-select output level supplied to the group of scanning electrodes during a non-select period, and (b) $V_{BH1}$, $V_{BH2}$, $V_{BL2}$, and $V_{BL1}$, which are output levels of the driving signal, supplied to the group of signal electrodes, satisfying a relationship of $V_{BH1}>V_{BH2}>V_C>V_{BL2}>V_{BL1}$.

With this arrangement, the power source circuit supplies, as the output level of the driving signal, output levels of two values which are different from each other above and below $V_C$, which is a non-select output level of the group of scanning electrodes.

Thus, driving of the liquid crystal in AC can be carried out by alternately outputting the output levels of two values between which is $V_C$, and the changing period can be set by switching to the other output level on the side of the same polarity with respect to $V_C$. This is realized by selecting the output level based on the alternate control section and the period control section.

It is also possible to set the output levels of two values on the side of the same polarity with respect to $V_C$ while placing between these two output levels a value corresponding to the output level of the conventional signal electrode group. Therefore, a decrease in effective voltage can be prevented even when the changing period is set.

As a result, with this arrangement, the changing period can be set by a circuit having a relatively simple structure, and it is possible to prevent lowering of contrast caused by a decrease in effective voltage, and deterioration of image quality even when the changing period is provided.

In order to achieve the above object, a driving method of a liquid crystal display device of the present invention for driving a liquid crystal sandwitched between a group of signal electrodes and a group of scanning electrodes which are disposed to intersect with the group of signal electrodes, by a driving potential difference between the group of signal electrodes and the group of scanning electrodes facing each other, includes the steps of: (1) providing in a driving signal of the group of signal electrodes a changing period for changing an output level of the driving signal at least once in a single scanning period; (2) controlling the changing period based on a change in the driving signal and a change in an alternating signal; and (3) correcting, by the control of the changing period, a driving voltage error generated by distortion which is generated on the group of scanning electrodes by the driving signal of the group of signal electrodes.

With this method, the driving voltage error which is generated by the distortion generated on the group of scanning electrodes by the driving signal of the group of signal electrodes are corrected by controlling the changing period for changing the output level of the driving signal of the group of signal electrodes in a single scanning period. Thus, compared with the conventional case where the changing period is fixed, luminous non-uniformity generated by the driving voltage error can be further reduced.

Further, with the above method, the driving voltage error is corrected by predicting the generation of the driving voltage error based on a change in the driving signal and a change in the alternating signal, and for this reason the conventional mechanism for detecting and correcting the driving voltage error can be omitted, thus simplifying the mechanism for correction.

As a result, with the above method, by controlling the changing period for changing the output level of the driving signal in a single scanning period based on a change in the driving signal and a change in the alternating signal, there are obtained effects of preventing luminous non-uniformity and simplifying the mechanism.

In order to achieve the above object, another driving method of a liquid crystal display device for driving a liquid crystal sandwitched between a group of signal electrodes which are driven by a driving signal in accordance with display data and a group of scanning electrodes which are disposed to intersect with the group of signal electrodes, includes the steps of: (1) comparing display data and display data of a preceding scanning period in a signal electrode group side driving circuit which drives the group of signal electrodes; and (2) correcting, when there is a difference between the display data compared in the step (1), a driving voltage error generated by blunted waveform of the driving signal, by controlling a changing period for changing an output level of the driving signal in a single scanning period.

The driving voltage error generated by blunted waveform of the driving signal is generated when there is a difference between display data and display data of a preceding scanning period. With the above method, the display data and the display data of the preceding scanning period are compared and when there is a difference between the two, the driving voltage error is corrected by controlling the changing period for changing the output level of the driving signal in a single scanning period. Thus, luminous non-uniformity generated by the driving voltage error can be further reduced compared with the conventional case where the changing period is fixed.

Further, with the above method, the driving voltage error is corrected by predicting the generation of the driving voltage error by comparing the display data and the display data of a preceding scanning period, thus omitting the conventional mechanism for detecting and correcting the driving voltage error and simplifying the mechanism for correction.

As a result, with the above method, by controlling the changing period for changing the output level of the driving signal in a single scanning period based on a change in the driving signal and a change in the alternating signal, there are obtained effects of preventing luminous non-uniformity on the display and simplifying the mechanism.

In order to achieve the above object, another driving method of a liquid crystal display device of the present invention for alternately and inversely driving by an alternating signal a liquid crystal sandwitched between a group of signal electrodes which are driven by driving signal in accordance with display data and a group of scanning electrodes which are disposed to intersect with the group of signal electrodes, includes the steps of: (1) comparing, when the alternating signal is inverted, display data and display data of a preceding scanning period in a signal electrode group side driving circuit which drives the group of signal electrodes; and (2) correcting, when the display data compared in the step (1) are the same, a driving voltage error generated by blunted waveform of the driving signal, by controlling a changing period for changing an output level of the driving signal in a single scanning period. The driving voltage error generated by blunted waveform of the driving signal is generated when the alternating signal is inverted and the display data and the display data of the preceding scanning period are the same. Thus, with the above method, the driving voltage error generated by such a blunted waveform of the driving signal is corrected in the signal electrode group side driving circuit by comparing the display data and the display data of the preceding scanning period, and when the display data compared are the same, by controlling the changing period for changing the output level of the driving signal in a single scanning period. Therefore, luminous non-uniformity generated by the driving voltage error can be further reduced compared with the conventional case where the changing period is fixed.

Further, with the above method, when the alternating signal is inverted, the driving voltage error can be corrected by predicting the generation of the driving voltage error by comparing the display data and the display data of the preceding scanning period, thus omitting the conventional mechanism of detecting and correcting the driving voltage error and simplifying the mechanism for correction.

As a result, with the above method, by controlling the changing period for changing the output level of the driving signal in a single scanning period based on a change in the driving signal and a change in the alternating signal, there are obtained the effects of preventing luminous non-uniformity on the display and simplifying the mechanism.

For a fuller understanding of the nature and advantages of the invention, reference should be made to the ensuing detailed description taken in conjunction with the accompanying drawings.

DESCRIPTION OF THE EMBODIMENTS

The following will describe one embodiment of the present invention referring to FIG. 1 through FIG. 9.

Figure 1:
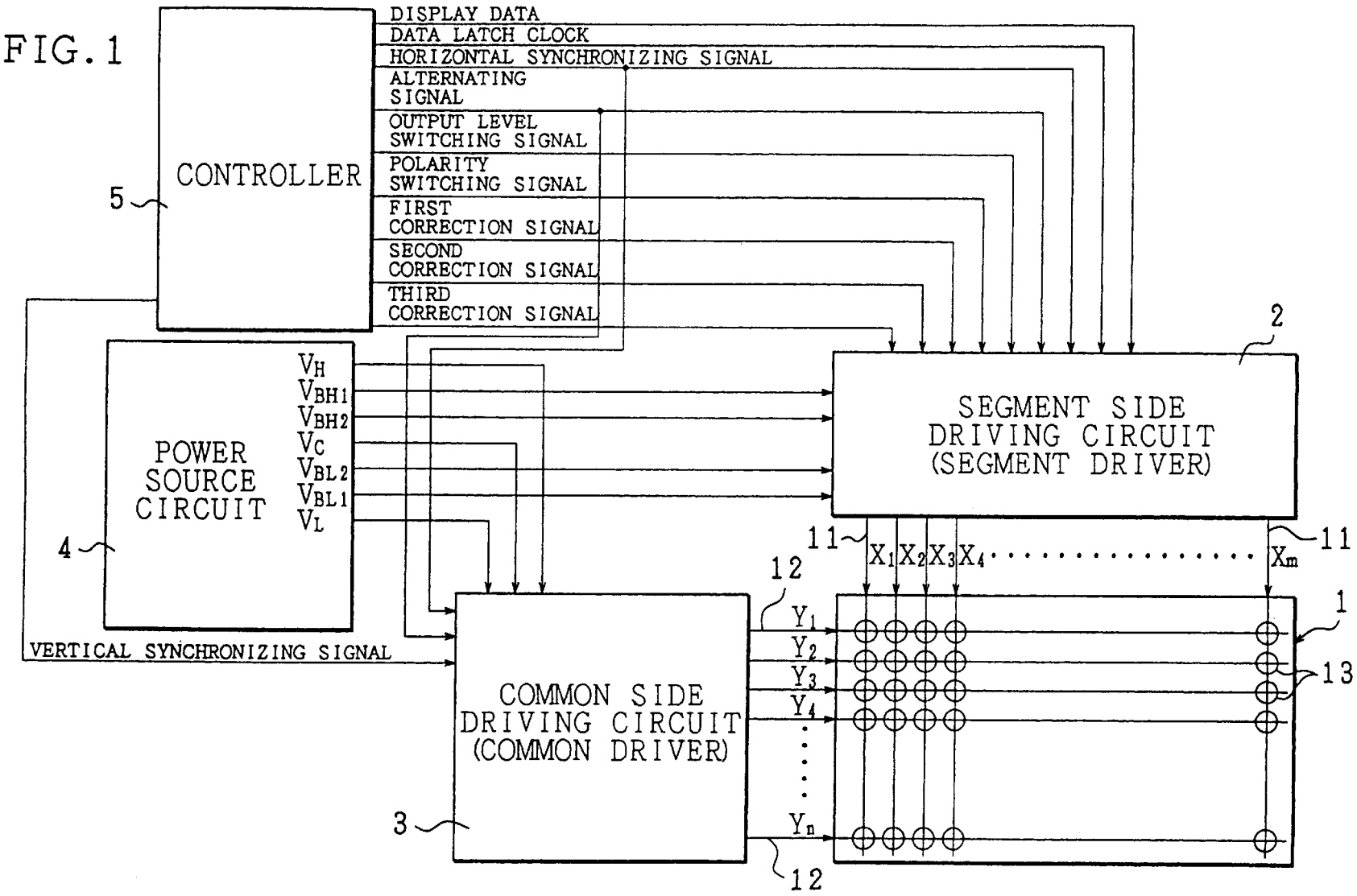
FIG. 1 is a block diagram showing a schematic structure of a driving circuit of a liquid crystal display device of one embodiment of the present invention.

FIG. 1 shows a schematic arrangement of a driving device of a liquid crystal panel, as a liquid crystal display device in accordance with the embodiment of the present invention. As shown in FIG. 1, the driving device includes segment electrodes (signal electrode group) 11 which are column electrodes provided on a first substrate (not shown) of a liquid crystal panel 1, and common electrodes (scanning electrode group) 12 which are row electrodes provided on a second substrate (not shown) of the liquid crystal panel 1.

The segment electrodes 11 are driven by a display data signal (driving signal) from a segment side driving circuit (signal electrode group side driving circuit) 2, which is a segment driving pulse in accordance with display data. The common electrodes 12 are driven by a common driving pulse from a common side driving circuit 3. The common driving pulse is for instructing select and non-select of the common electrodes 12.

Liquid crystal is enclosed between the first substrate and the second substrate of the liquid crystal panel 1, the second substrate facing and being substantially parallel to the first substrate. As the liquid crystal, a liquid crystal of a non-memory type, such as a liquid crystal of a TN (Twist Nematic) type or STN (Super Twist Nematic) type is used. The portion where the segment electrodes 11 and the common electrodes 12 face and intersect each other constitutes a liquid crystal cell 13 as a pixel, which is formed in matrix, that is, in the form of a cell on a chess board. Note that, in the present invention, instead of using a liquid crystal of a non-memory type, a liquid crystal of a memory type, such as ferroelectric liquid crystal can also be used.

To the segment side driving circuit 2 and the common side driving circuit 3 are given a power source and a control signal respectively from a power source circuit 4 and a controller (control means, alternate control means, period control means, first signal generating means, and second signal generating means) 5. The control signal given to the segment side driving circuit 2 from the controller 5 includes a display data signal, a data latch clock for taking in the display data signal, a horizontal synchronizing signal, and an alternating signal for driving the liquid crystal in AC. The control signal given to the common side driving circuit 3 from the controller 5 includes a horizontal synchronizing signal, an alternating signal, and a vertical synchronizing signal.

Figure 6:
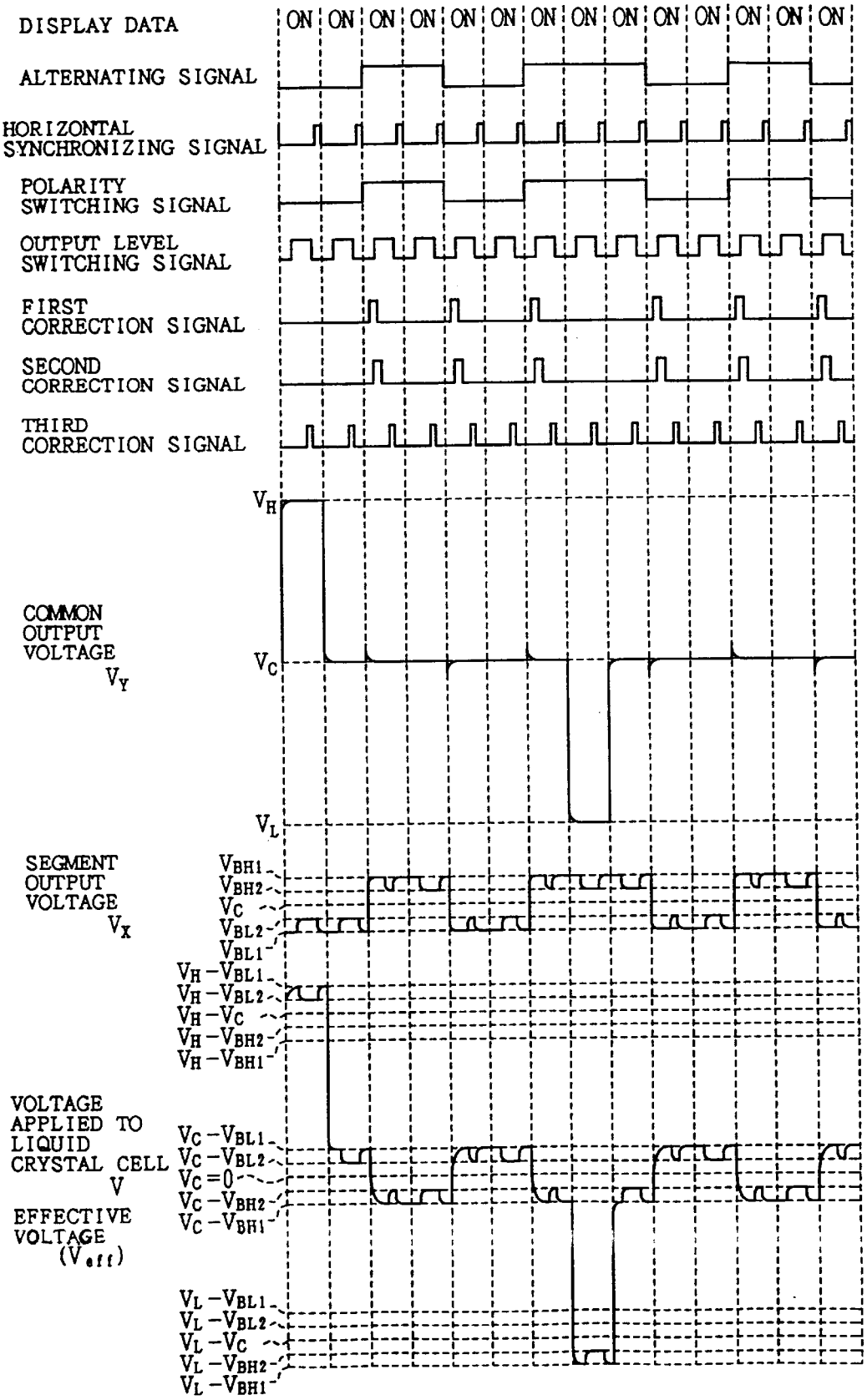
FIG. 6 is a timing chart showing an operation of a whole screen ON display on a liquid crystal panel of the liquid crystal display device.
Figure 7:
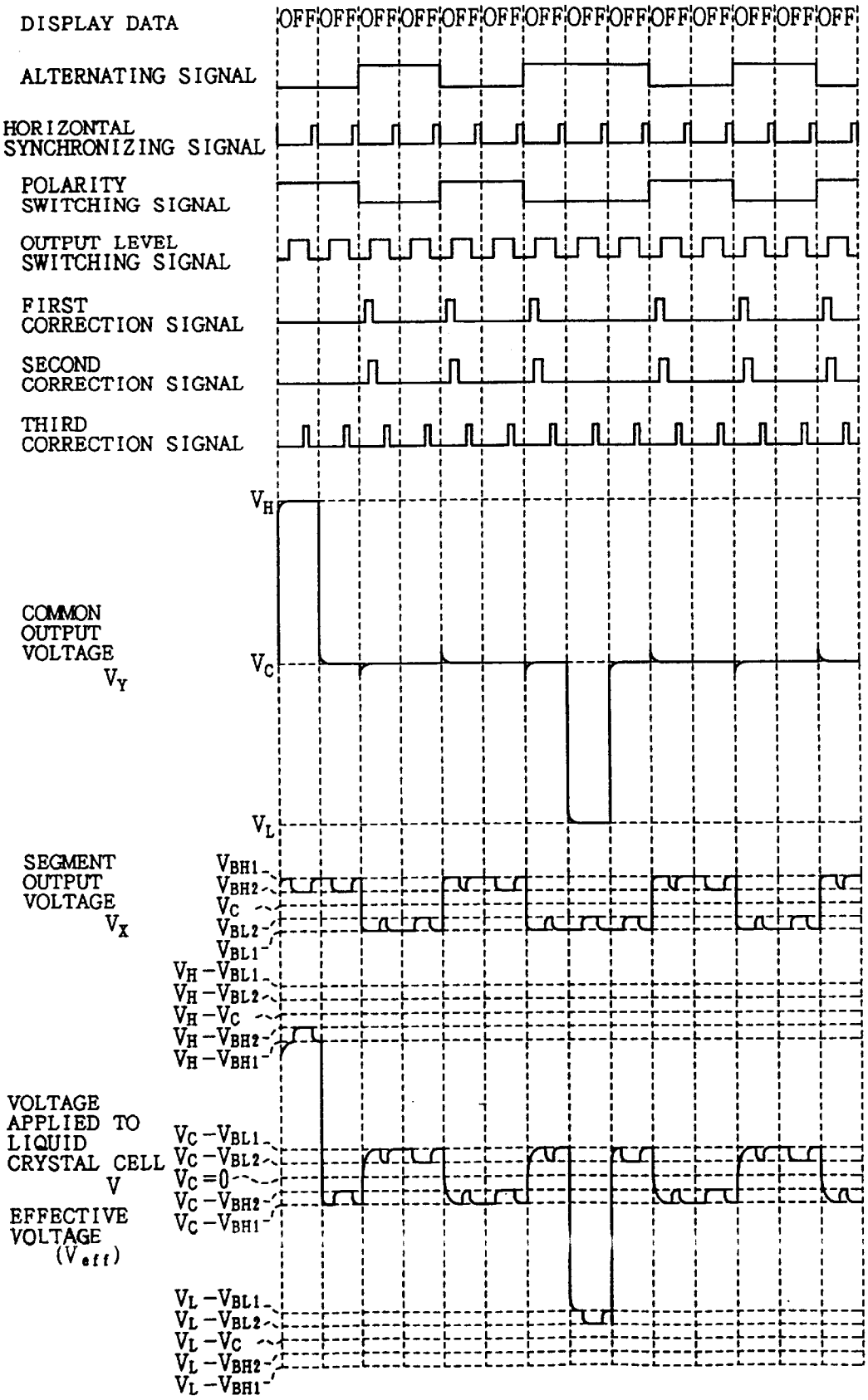
FIG. 7 is a timing chart showing an operation of a whole screen OFF display on the liquid crystal panel of the liquid crystal display device.
Figure 8:
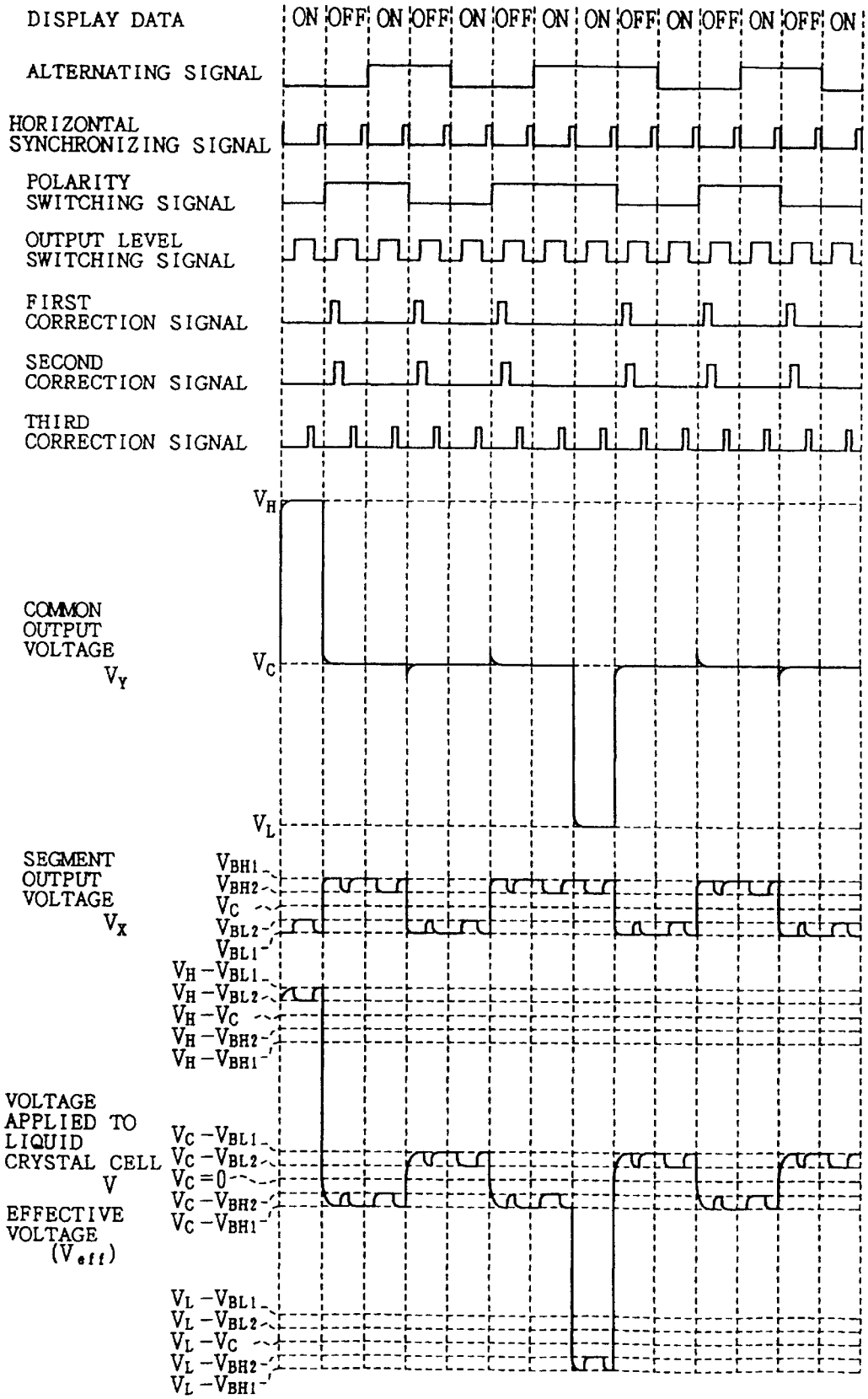
FIG. 8 is a timing chart showing an operation of a stripe display on the liquid crystal panel of the liquid crystal display device.
Figure 9:
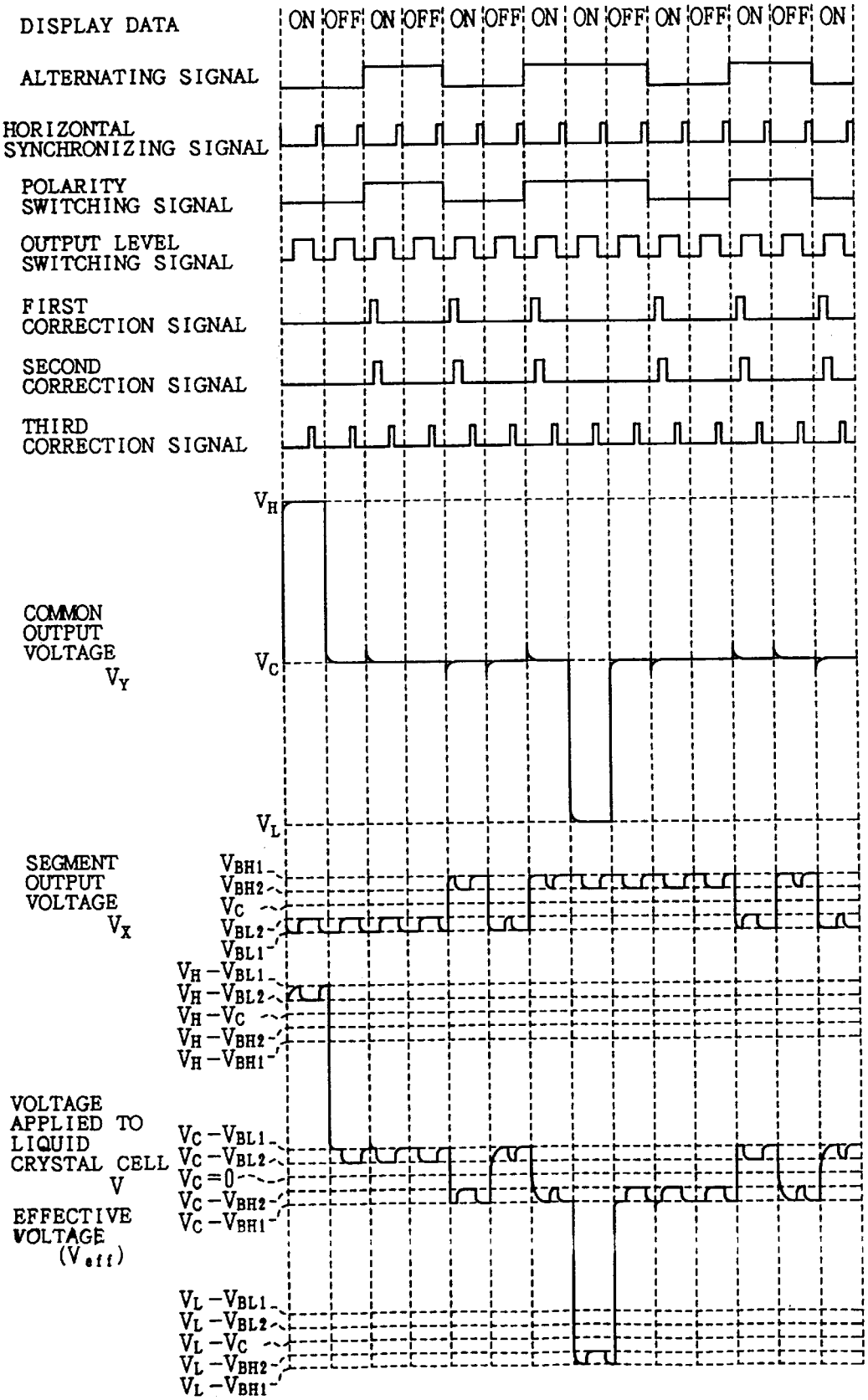
FIG. 9 is a timing chart showing an operation of a block display by the driving circuit.
Figure 10:
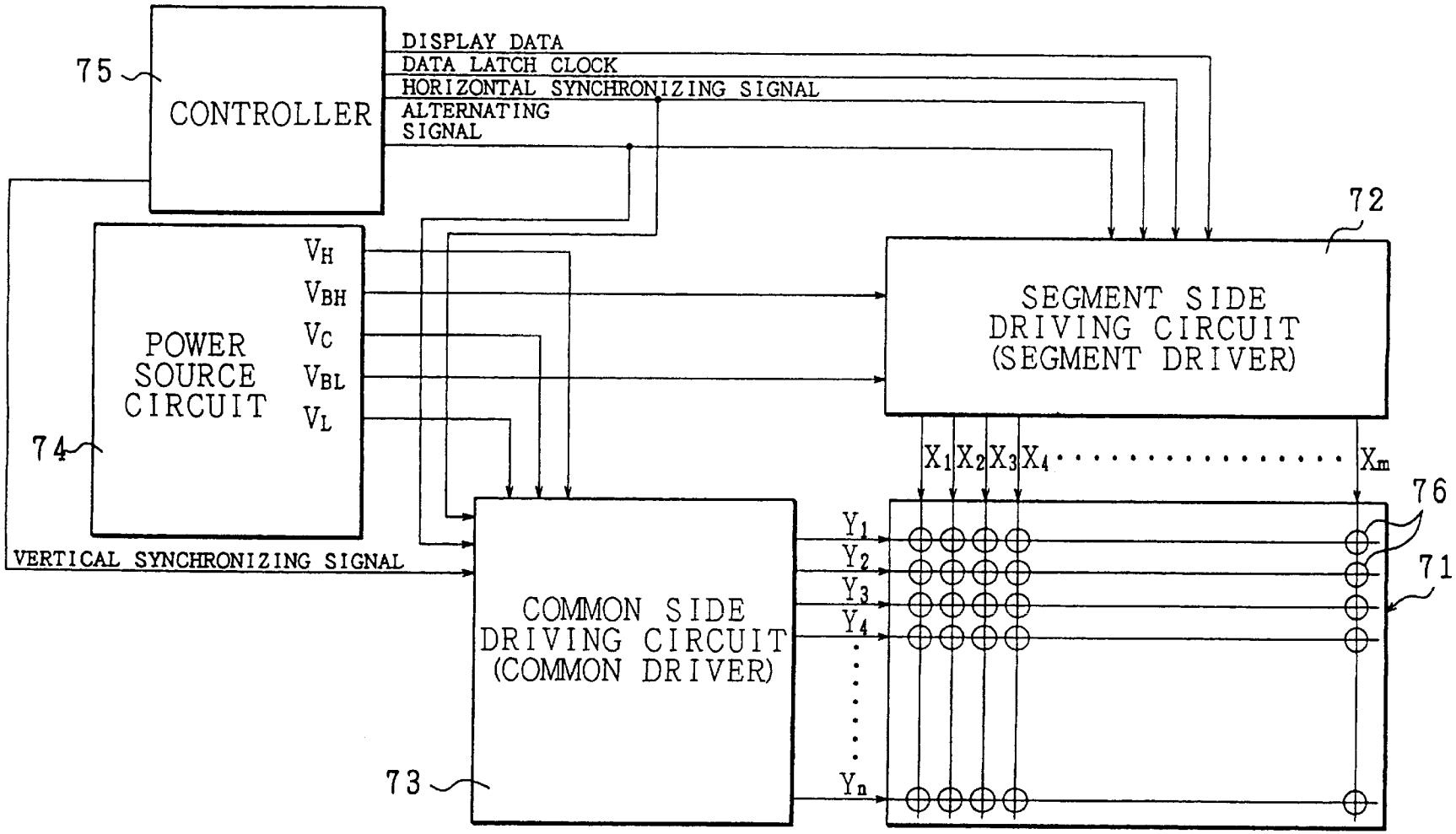
FIG. 10 PRIOR ART
FIG. 10 is a block diagram of a conventional liquid crystal display device driving a liquid crystal panel.
Figure 11:
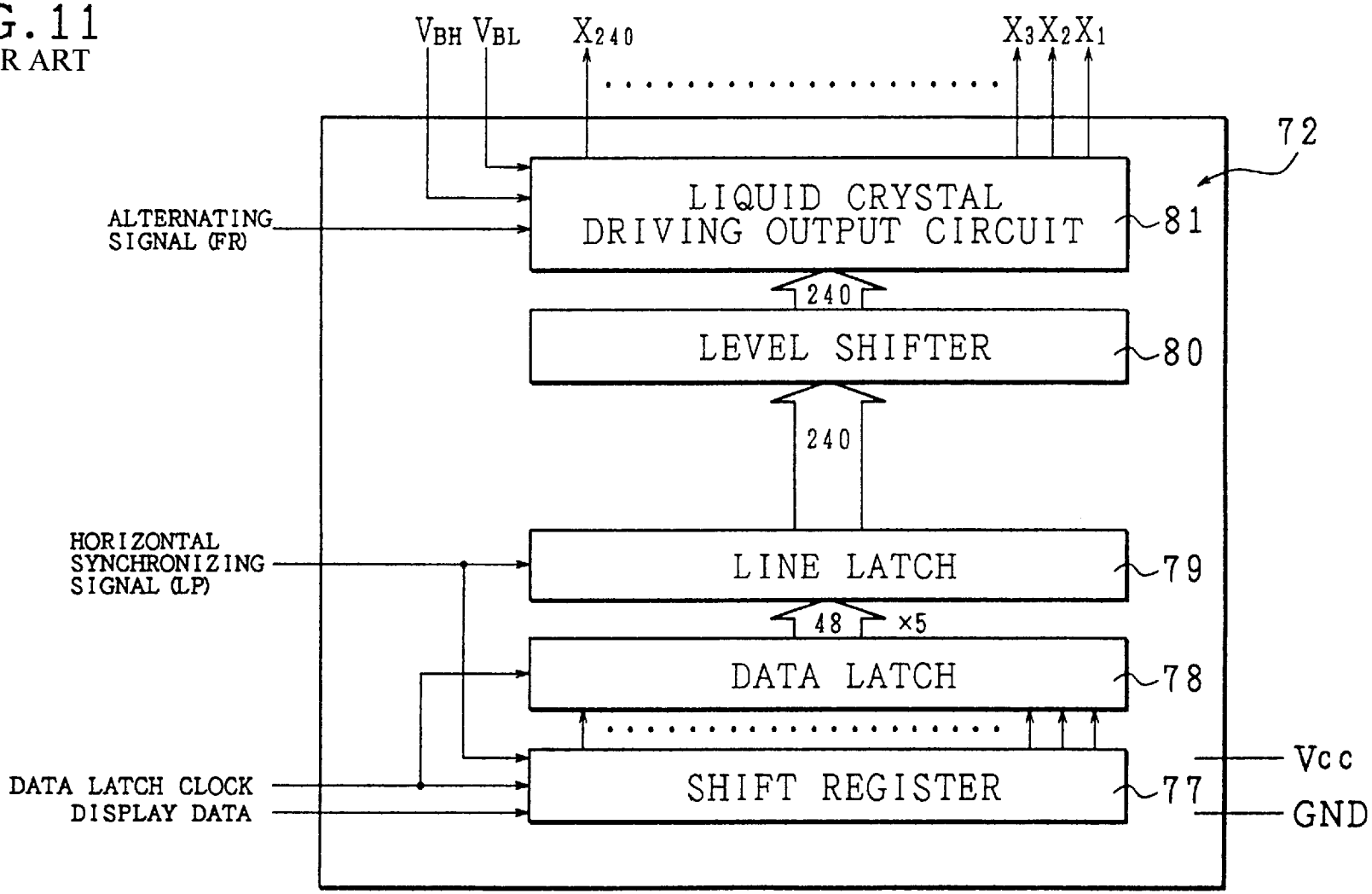
FIG. 11 PRIOR ART
FIG. 11 is a block diagram of a segment side driving circuit of the conventional liquid crystal display device.
Figure 12:
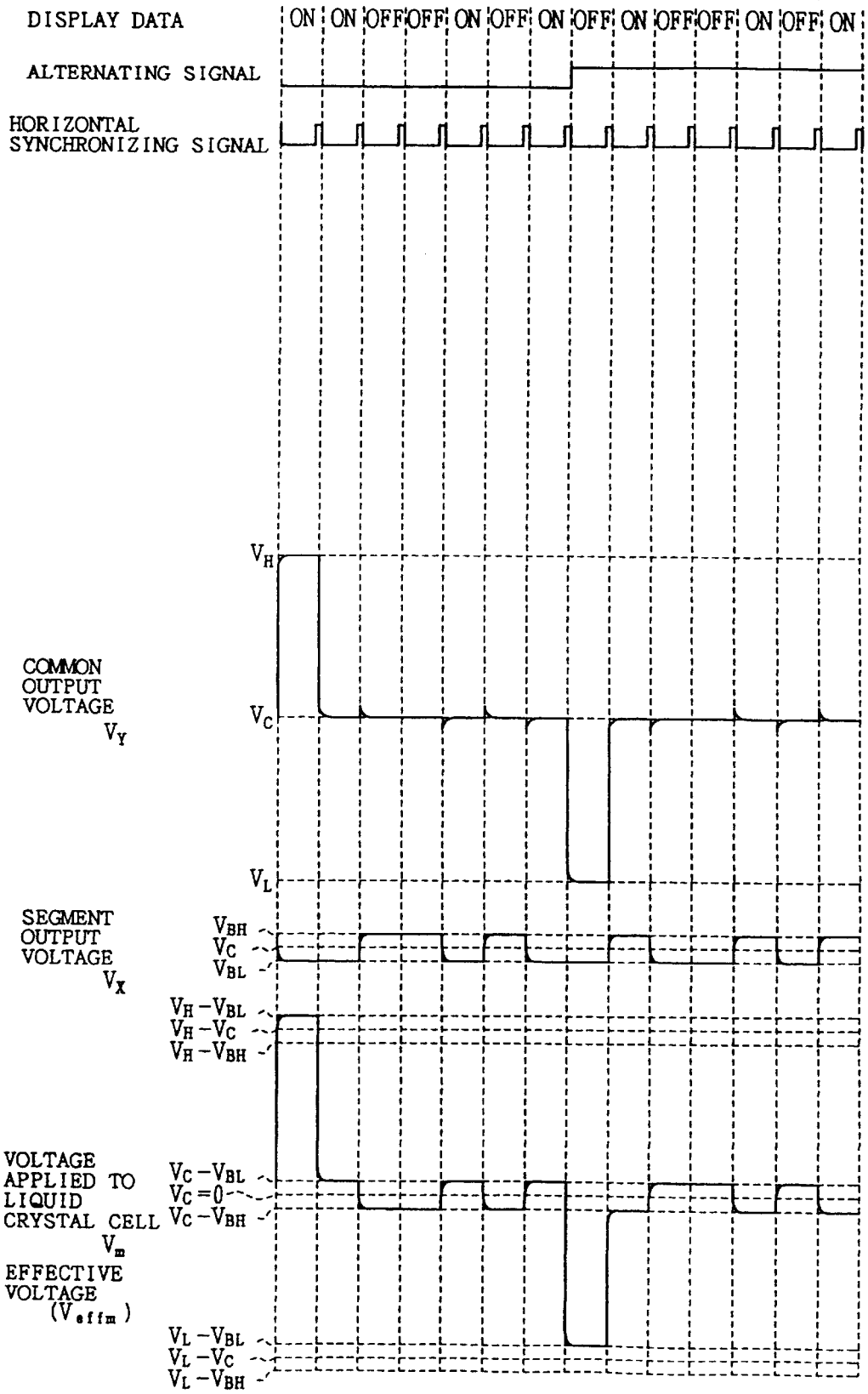
FIG. 12 PRIOR ART
FIG. 12 is a timing chart showing operations of display on a liquid crystal panel of the conventional liquid crystal display device.
Figure 13:
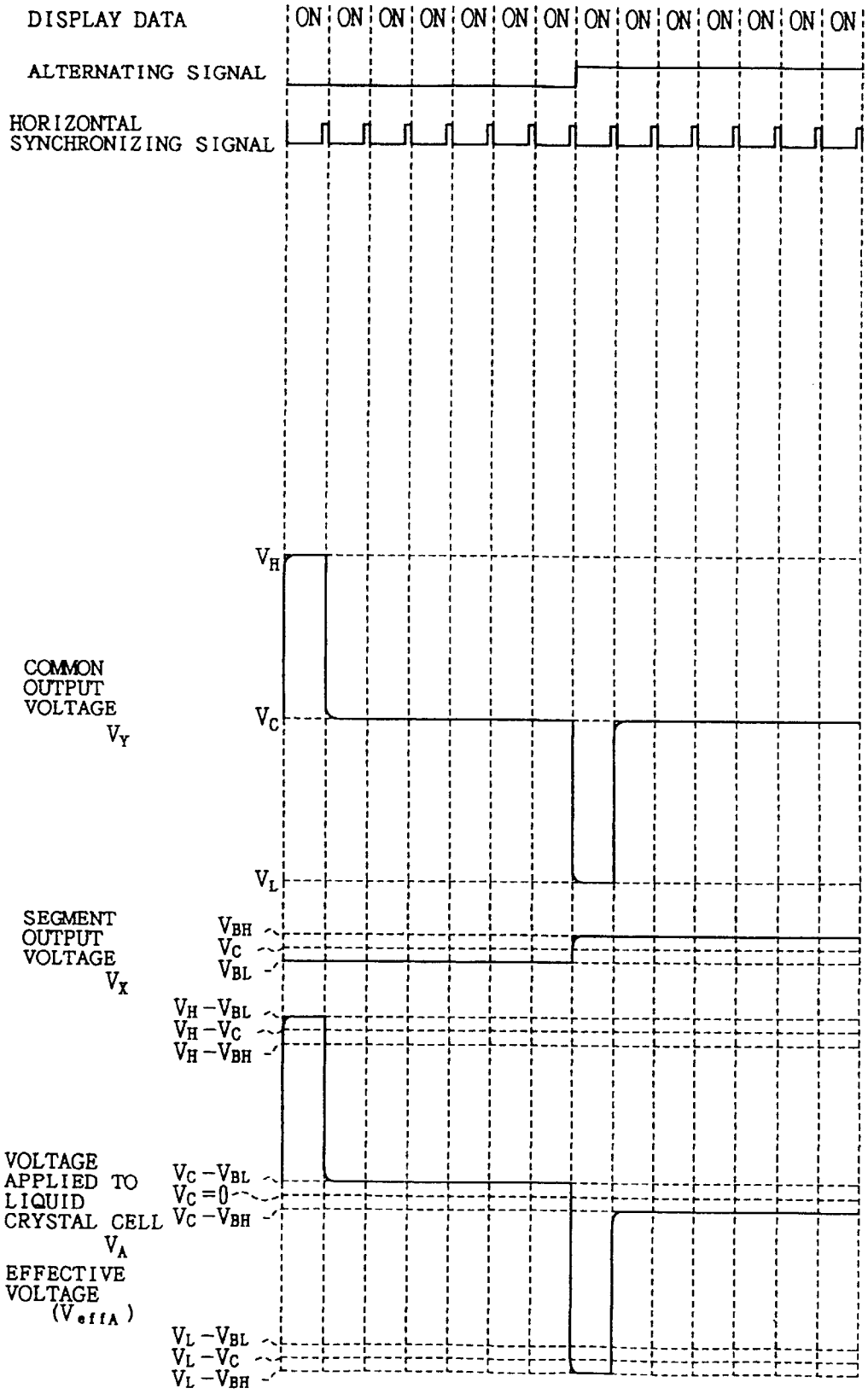
FIG. 13 PRIOR ART
FIG. 13 is a timing chart showing an operation of a whole screen ON display on the liquid crystal panel of the conventional liquid crystal display device.
Figure 14:
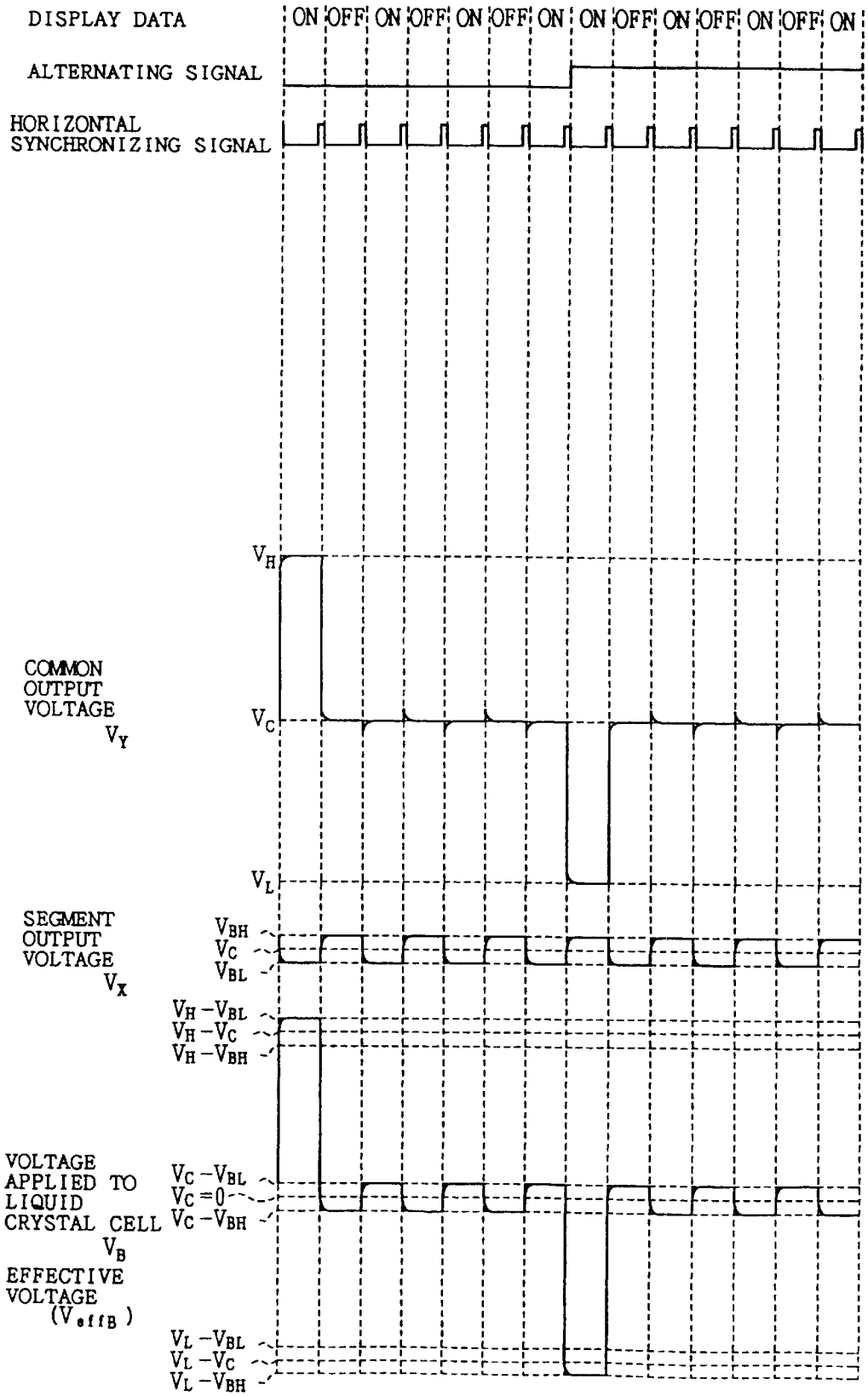
FIG. 14 PRIOR ART
FIG. 14 is a timing chart showing an operation of a stripe display on the liquid crystal panel of the conventional liquid crystal display device.
Figure 15:
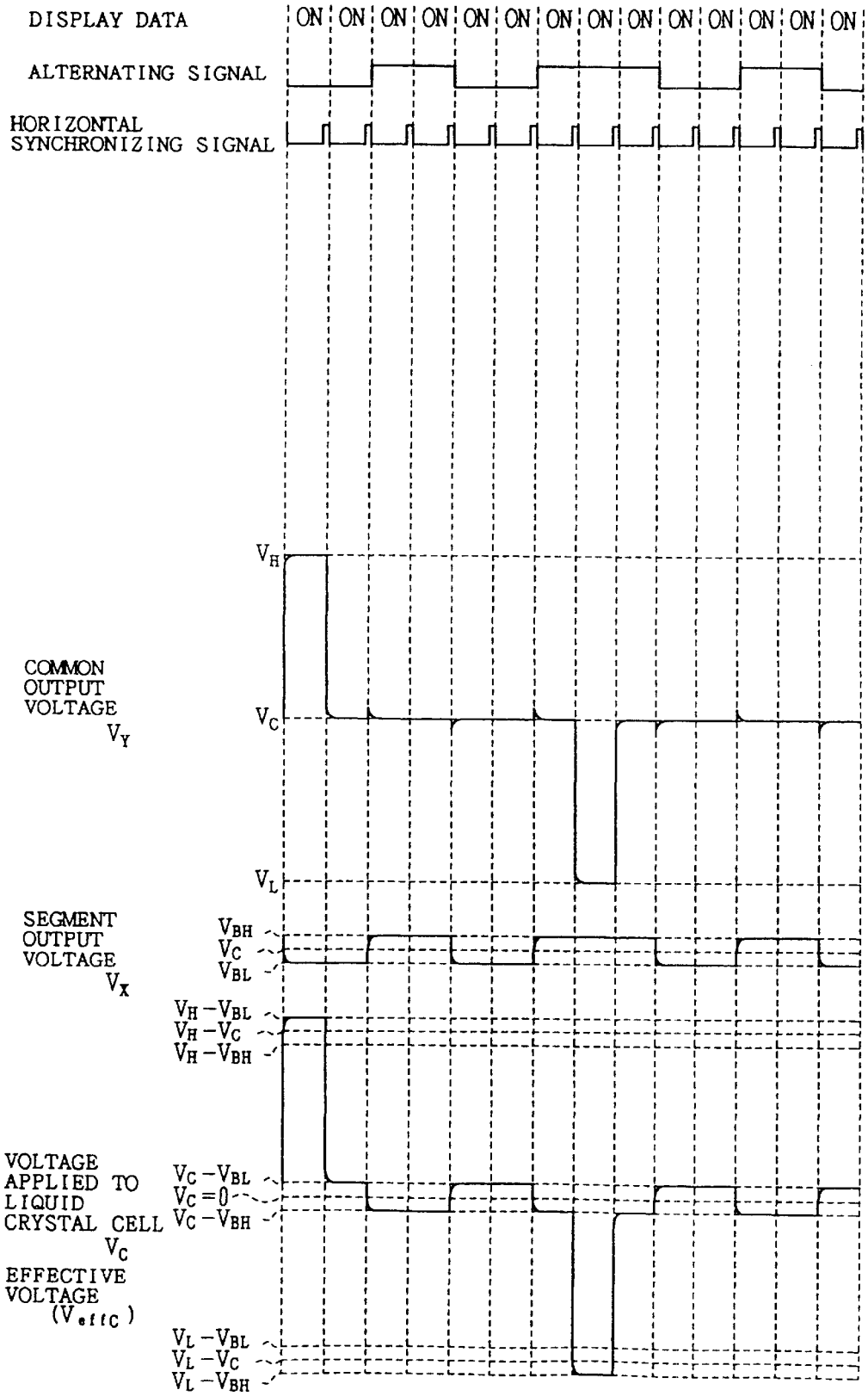
FIG. 15 PRIOR ART
FIG. 15 is a timing chart showing operations in response to a change in alternating signal when carrying out a whole screen ON display on the liquid crystal panel of the conventional liquid crystal display device.
Figure 16:
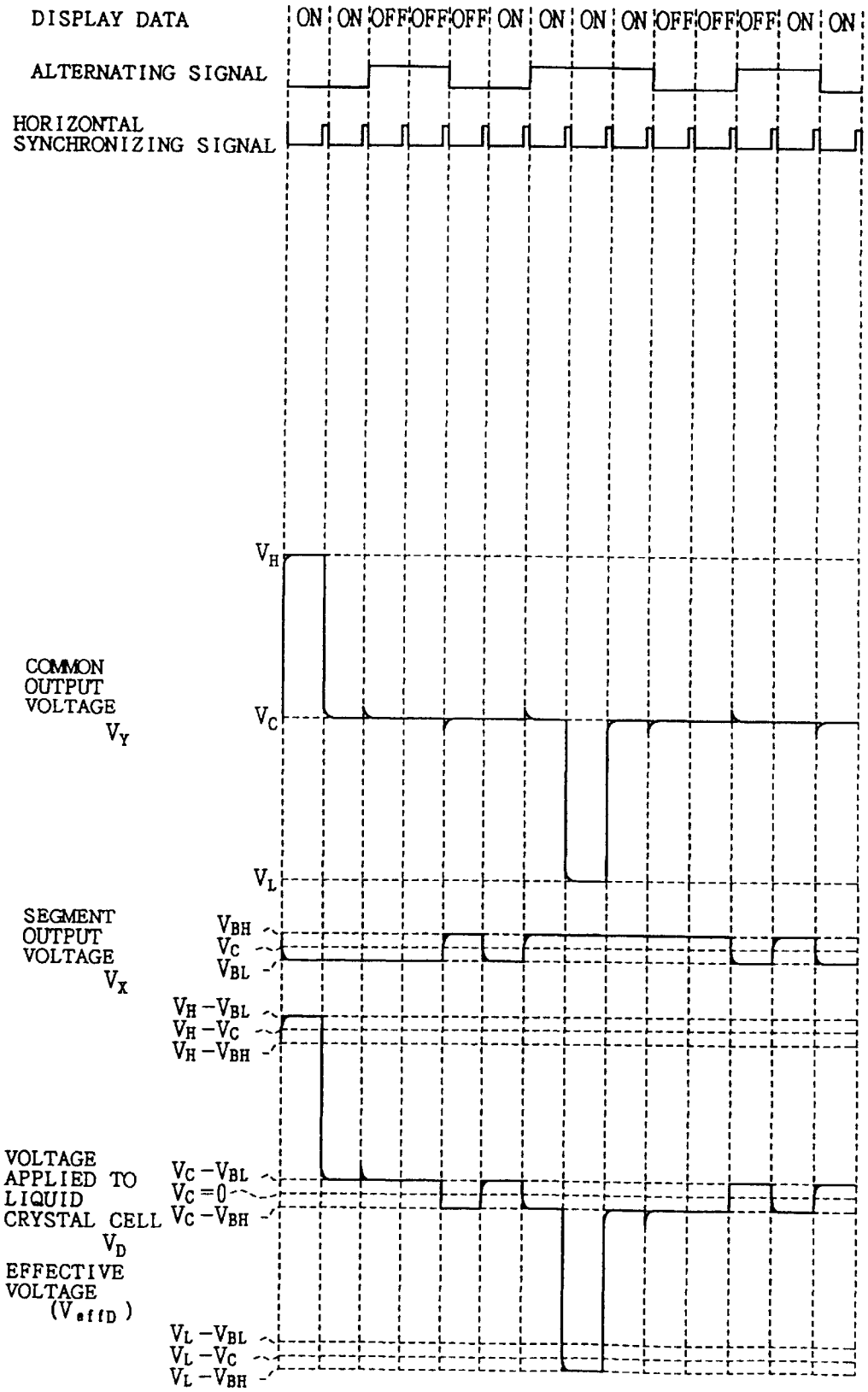
FIG. 16 PRIOR ART
FIG. 16 is a timing chart showing an operation of a whole screen OFF display on the liquid crystal panel of the conventional liquid crystal display device.
Figure 17:
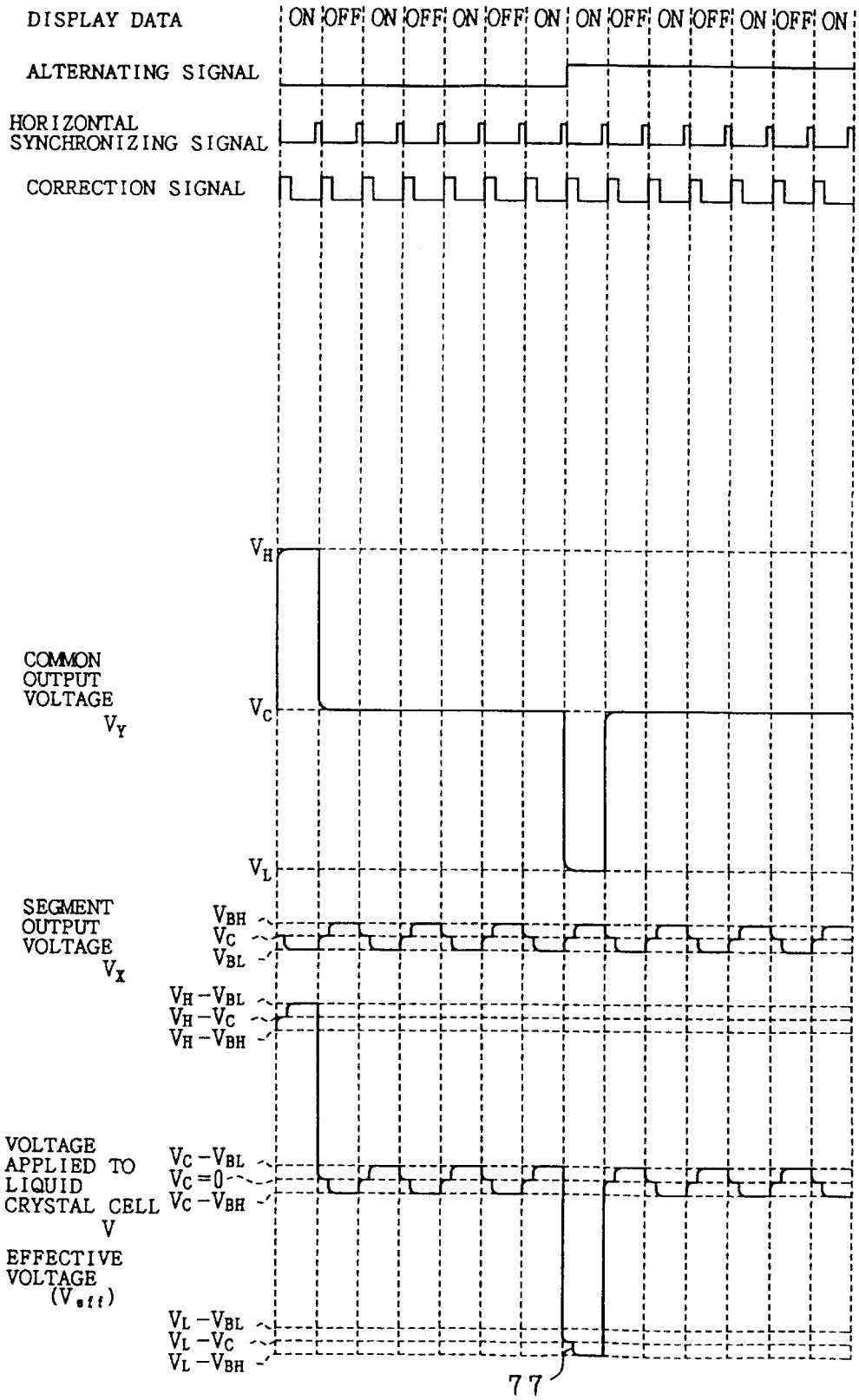
FIG. 17 PRIOR ART
FIG. 17 is a timing chart showing operations of driving a liquid crystal panel of another conventional liquid crystal display device.
Figure 18:
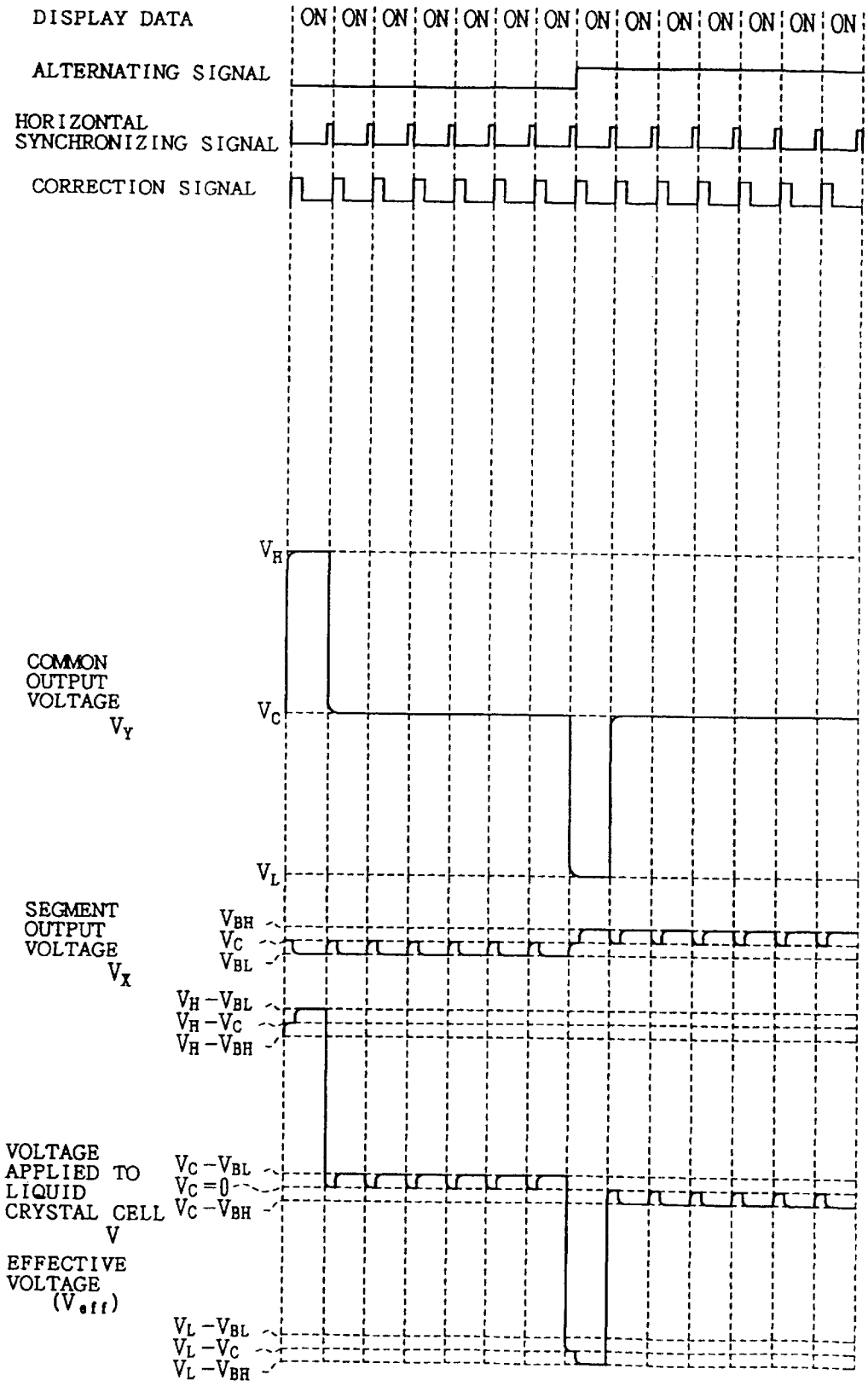
FIG. 18 PRIOR ART
FIG. 18 is a timing chart showing an operation of a whole screen ON display on the liquid crystal panel of the conventional liquid crystal display device.
Figure 19:
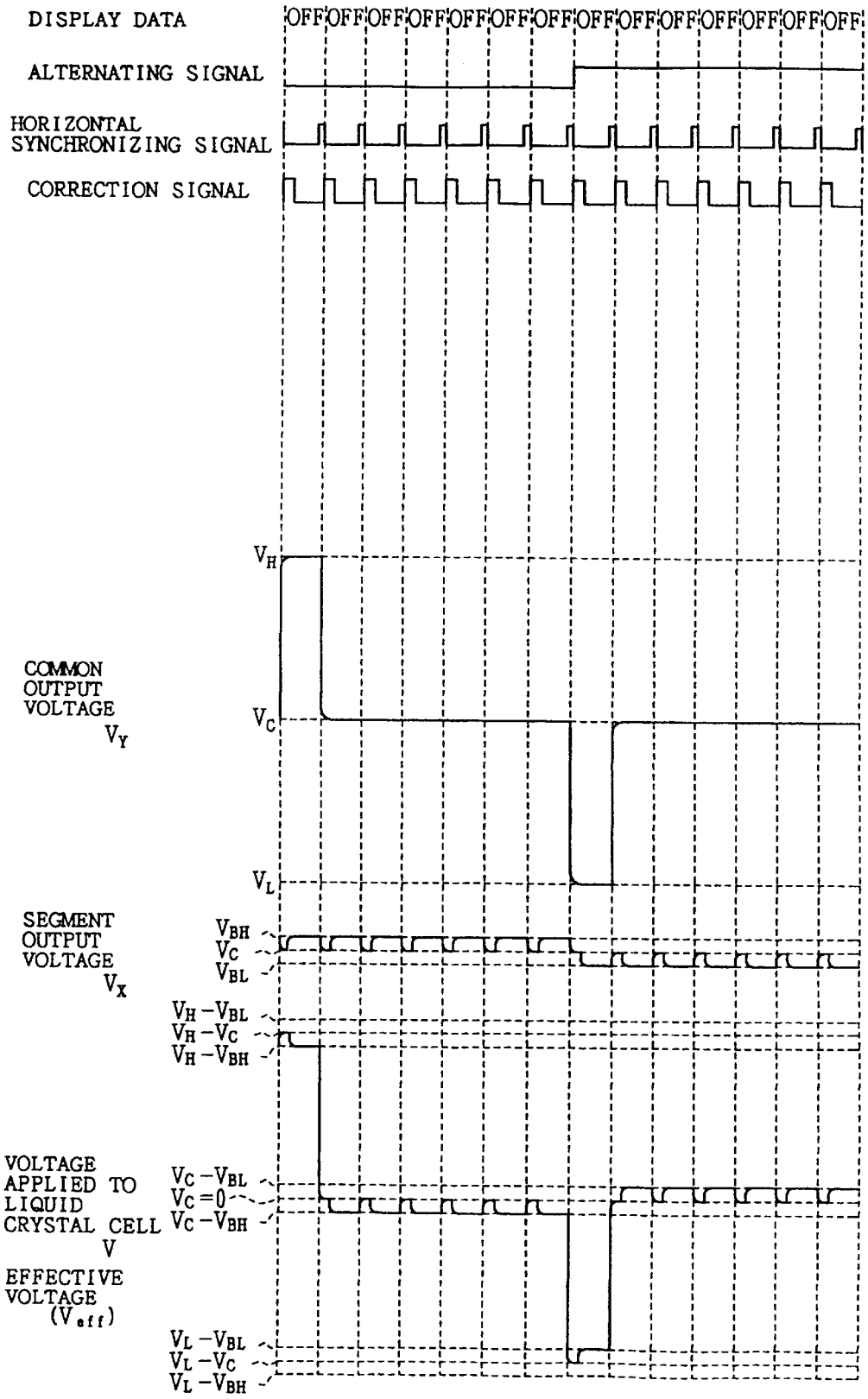
FIG. 19 PRIOR ART
FIG. 19 is a timing chart showing an operation of a whole screen OFF display on the liquid crystal panel of the conventional liquid crystal display device.
Figure 20:
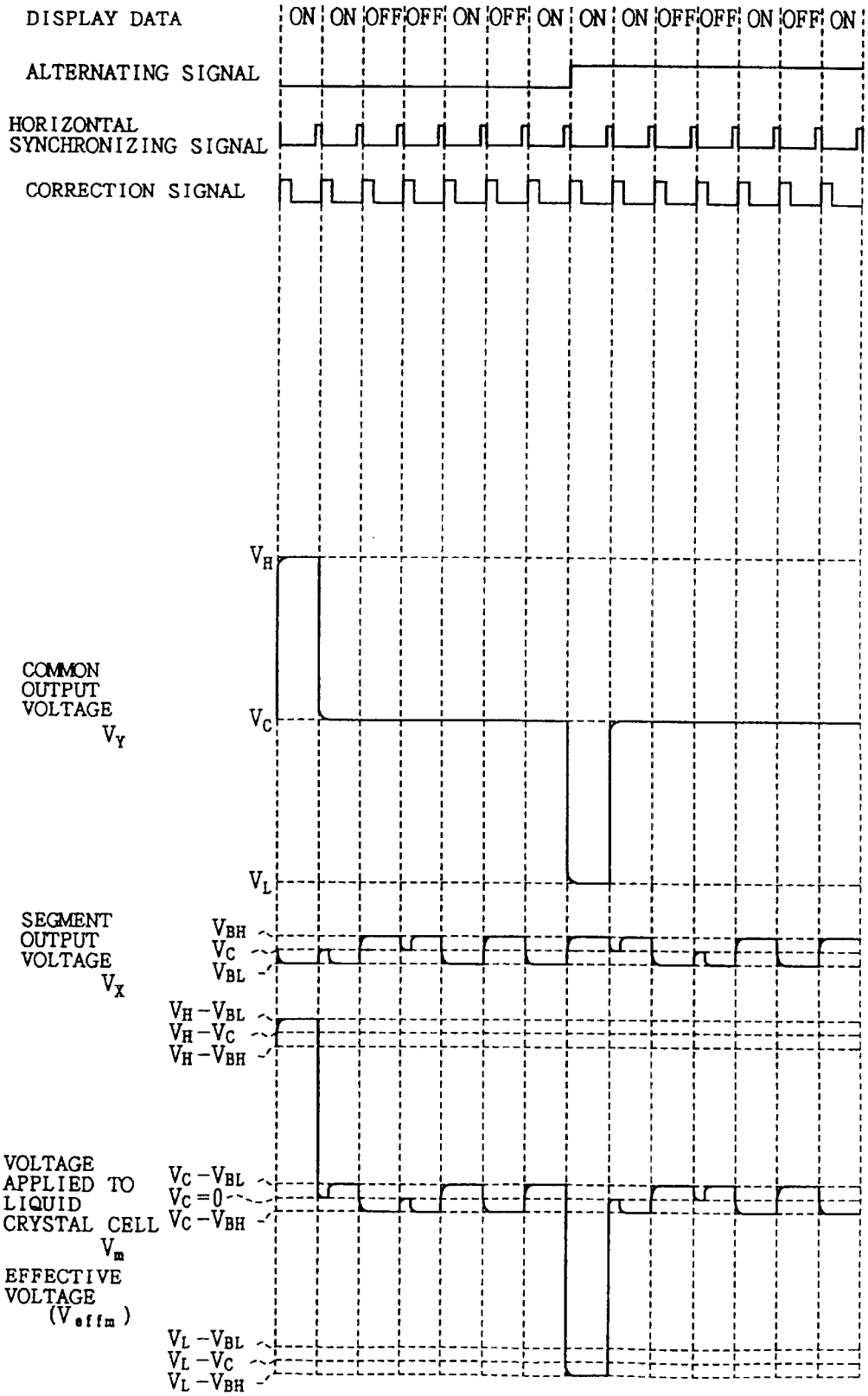
FIG. 20 PRIOR ART
FIG. 20 is a timing chart showing operations of driving a liquid crystal panel of yet another conventional liquid crystal display device.

The common side driving circuit 3, upon receiving the vertical synchronizing signal, selects $Y_1$ of the common electrodes 12 on the first column, and a common driving pulse (common output voltage), for example, as shown in FIG. 6 is outputted to each common electrode 12 in such a manner that the following $Y_2$, $Y_3$, . . . and $Y_n$ of the common electrodes 12 are successively selected every time the horizontal synchronizing signal is given.

To the segment side driving circuit 2 from the power source circuit 4 are given voltages of four values $V_{BH1}$, $V_{BH2}$, $V_{BL2}$, and $V_{BL1}$ as "H" level or "L" level of the display data signal. To the common side driving circuit 3 are given voltages of three values $V_H$, $V_C$, and $V_L$ as potentials of the common driving pulse.

The liquid crystal cell 13 is set such that the liquid crystal is driven by an accumulative potential difference by the potential difference between voltages $V_{BH1}$, $V_{BH2}$, $V_{BL2}$, and $V_{BL1}$ and voltages $V_H$, $V_C$, and $V_L$. The voltages $V_{BH1}$, and $V_{BH2}$ correspond to a conventional $V_{BH}$, and the voltages $V_{BL1}$ and $V_{BL2}$ correspond to a conventional $V_{BL}$. In the present embodiment, $V_{BH1}$ is set to be larger than the conventional $V_{BH}$, and $V_{BH2}$ to be smaller than the conventional $V_{BH}$. Also, $V_{BL1}$ is set to be smaller than the conventional $V_{BL}$, and $V_{BL2}$ to be larger than the conventional $V_{BL}$. Namely, the relationship of $V_{BH1}>V_{BH}>V_{BH2}>V_C>V_{BL2}>V_{BL}>V_{BL1}$ is satisfied.

The controller 5 also outputs the following signals to the segment side driving circuit 2: an output level switching signal, a first correction signal, a second correction signal, a third correction signal, and a polarity switching signal (see FIG. 5 to be described later).

The polarity switching signal is in accordance with the number of times the display data change from ON to OFF and from OFF to ON, and with the alternating signal, and it is set so that the "H" level is outputted when there are larger numbers of liquid crystal cell 13 whose output change is on the side of $V_{BH1}$ and $V_{BH2}$, and that the "L" level is outputted when there are larger numbers of liquid crystal cell 13 whose output change is on the side of $V_{BL1}$ and $V_{BL2}$.

The output level switching signal is generated based on, for example, a fall time of the horizontal synchronizing signal, and it is a pulse (rectangular wave) whose "L" level and "H" level are alternately repeated such that the pulse changes from "L" level to "H" level (first switching timing) and back to "L" level (second switching timing) in a period between adjacent fall times of the horizontal synchronizing signal. Also, the output level switching signal is set so that the period of one cycle thereof is the same as that of the horizontal synchronizing signal.

In the present embodiment, the output level switching signal is set such that the mid point (point of half period) of the "L" level period is at the fall time of the horizontal synchronizing signal. Also, the output level switching signal is set such that the duty ratio, which is the proportion of an "H" level period in a period of adjacent "H" level and "L" level, is 50 percent.

The first correction signal is a pulse which is generated based on the polarity switching signal and the output level switching signal, whose "H" level and "L" level are alternately repeated. The first correction signal is generated in accordance with a rise time of the output level switching signal immediately after the polarity of the polarity switching signal is reversed.

The first correction signal becomes "H" level between the time the polarity of the polarity switching signal is reversed and the rise time of the output level switching signal (i.e., in the "L" level period of the output level switching signal), and becomes "L" level in the "H" level period of the output level switching signal. Namely, the output level switching signal rises while the first correction signal is at "H" level.

The second correction signal is a pulse which is generated based on the polarity switching signal and the output level switching signal, whose "H" level and "L" level are alternately repeated. The second correction signal is generated in accordance with a rise time of the output level switching signal immediately after the polarity of the polarity switching signal is reversed.

The second correction signal becomes "H" level between the time the polarity of the polarity switching signal is reversed and the rise time of the output level switching signal (i.e., in the "L" level period of the output level switching signal), and becomes "L" level in the "H" level period of the output level switching signal. Namely, the output level switching signal rises while the second correction signal is at "H" level.

Thus, the "H" level period of the first correction signal and the "H" level period of the second correction signal are partially overlapped, and the pulse of the second correction signal is shifted to follow the first correction signal with respect to time.

The third correction signal is based on the output level switching signal, and is generated in accordance with the fall time of the output level switching signal, and is a pulse whose "L" level and "H" level are alternately repeated.

Also, the third correction signal becomes "H" level in the "H" level period of the output level correction signal, and becomes "L" level in the "L" level period of the output level switching signal. Namely, the output level switching signal falls while the third correct ion signal is at an "H" level.

Figure 2:
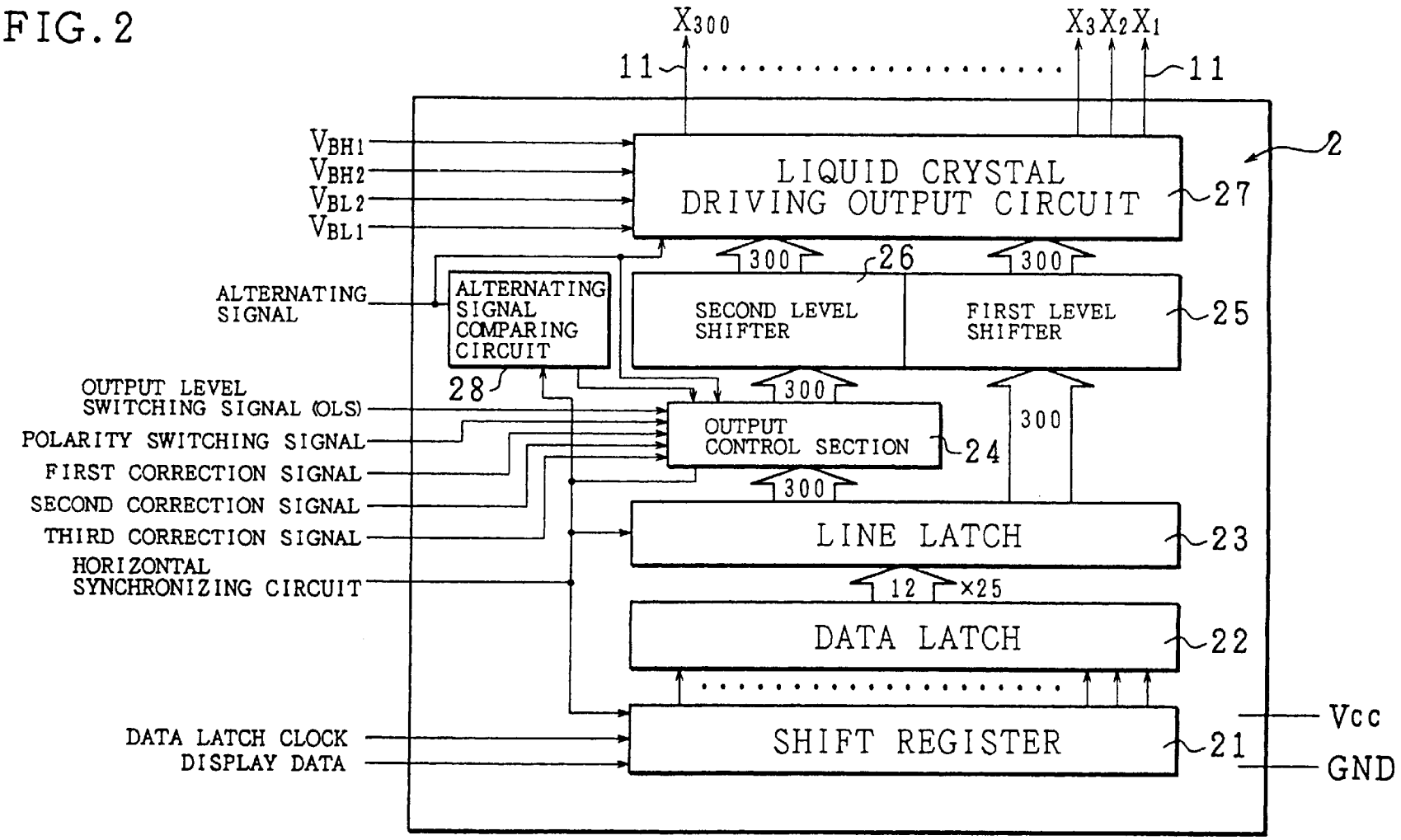
FIG. 2 is a block diagram showing an internal structure of a segment side driving circuit of the driving circuit.
Figure 3:
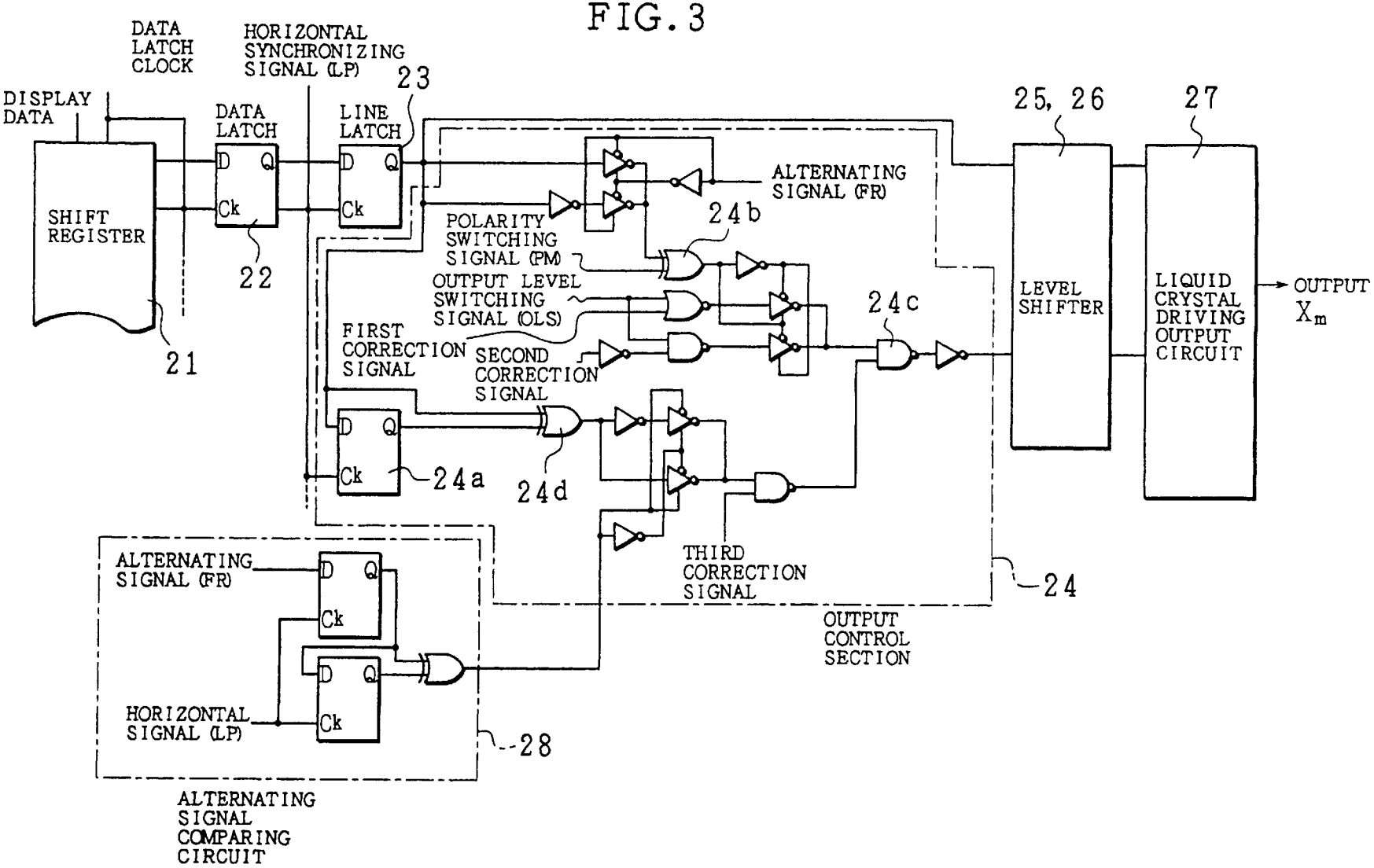
FIG. 3 is a block diagram showing a logic structure associated with an output control section of the segment side driving circuit.

As shown in FIG. 2 and FIG. 3, the segment side driving circuit 2 includes an output control section 24. The output control section 24 controls a correction time (change time) which varies with the output level switching signal, by the polarity switching signal from the controller 5 and by the first and second correction signals from the controller 5 so as to correct a segment output voltage (driving signal).

The output control section 24 also controls the correction time which varies with the output level switching signal, by the third correction signal only when different data (same data when alternating signal is switched) are outputted in successive scanning periods so as to carry out a correction.

FIG. 2 shows an internal structure of the segment side driving circuit 2 of FIG. 1. The segment side driving circuit 2 is capable of driving, for example, 300 segment electrodes 11 (indicated by $X_1, \ldots,$ and $X_{300}$). The display data signal is sent as a serial signal to a shift register 21, and is taken into a data latch 22 in synchronization with the data latch clock, and is latched after converted to a parallel signal. A line latch 23 latches the display data signal of the data latch 22 in synchronization with the horizontal synchronizing signal, and gives the display data signal thus latched to the output control section 24 and a first level shifter 25.

The output control section 24 carries out a control of the correction time by the following two methods. One is the control of correction time in which the output level is switched by the output level switching signal, the polarity switching signal, and the first and second correction signals. The other is the control of correction time in which the output level is switched by the result of comparison of display data signals in synchronization with the horizontal synchronizing signal and by the third correction signal.

The output of the output control section 24 is given to a second level shifter 26. The first level shifter 25 and the second level shifter 26 convert a signal level in such a manner that the voltage level which operates by a logic section of the segment side driving circuit 2 is converted into the voltage level of the liquid crystal driving system. The respective outputs of the first level shifter 25 and the second level shifter 26 are given to a liquid crystal driving output circuit 27. The alternating signal is also given to the liquid crystal driving output circuit 27.

The liquid crystal driving output circuit 27 gives an output voltage selected from $V_{BH1}$, $V_{BH2}$, $V_{BL2}$, and $V_{BL1}$ to each of the segment electrodes 11 ($X_1, \ldots$ and $X_{300}$) in accordance with the display data signal, the alternating signal, and the output control signal. There is also provided an alternating signal comparing circuit 28 which compares and detects inversion of the alternating signal based on the horizontal synchronizing signal.

FIG. 3 shows an example of the structure of the output control section 24 of FIG. 2, and an example of the structures of associated circuits. The data latch 22 and the line latch 23 are constituted by D-flip-flop circuits. The output control section 24 is composed of a D-flip-flop circuit 24*a*, EXOR circuits 24*b* and 24*d*, a NAND circuit 24*c*, an NOR circuit, a clocked inverter circuit, and an inverter circuit. In this circuit structure, the output waveform is such that the output level has been changed beforehand from $V_{BH1}$ level to $V_{BH2}$ level (from $V_{BL1}$ level to $V_{BL2}$ level) in the "H" level period of the output level switching signal.

The output control for the distortion of the common electrodes 12 is carried out by the first correction signal, the second correction signal, and the polarity switching signal, which are inputted to the segment side driving circuit 2 from the controller 5. First, the output of the line latch 23 and the polarity switching signal are compared in the EXOR circuit 24*b*. Then, one of (a) an NOR logic signal by the output level switching signal and the first correction signal or (b) a NAND logic signal by the output level switching signal and the second correction signal is selected in accordance with the result of comparison.

The output control for blunting of a segment output waveform when it changes is carried out by the third correction signal. The output of the line latch 23 and the horizontal synchronizing signal (LP) the same the line latch 23 are inputted to the data input and clock input of the D-flip-flop circuit 24*a* of the output control section 24, respectively. Namely, the output of the D-flip-flop circuit 24*a* becomes the data of the line latch 23 of a preceding horizontal synchronizing period.

The EXOR circuit 24*d* receives the output of the D-flip-flop circuit 24*a* and the output of the line latch 23, and makes the third correction signal effective when the display data signal of a preceding horizontal synchronizing period and the display data signal of the current scanning signal are different from each other in the ON display level and OFF display level.

In the case where the alternating signal is switched, the segment output, which is a display data signal, changes even when the display data signal of a preceding horizontal synchronizing period and the display data signal of the current scanning signal are the same in the ON display level and OFF display level, and for this reason the output of the EXOR circuit 24*d* is switched, and the third correction signal is made effective if the display data signals are the same. Here, the result of comparison of the alternating signals is given to the output control section 24 by the alternating signal comparing circuit 28.

The result of correction for distortion of the common electrodes 12 and the result of correction for blunting of the segment output waveform when it is changed are subjected to a logic operation by the NAND circuit 24*c*, and the result of operation is given to the level shifters 25 and 26. Note that, in the present embodiment, D-flip-flop circuits are used for the data latch 22, the line latch 23, and the output control section 24. However, these components may be realized by other types of latch circuits, such as a half-latch circuit.

Figure 4:
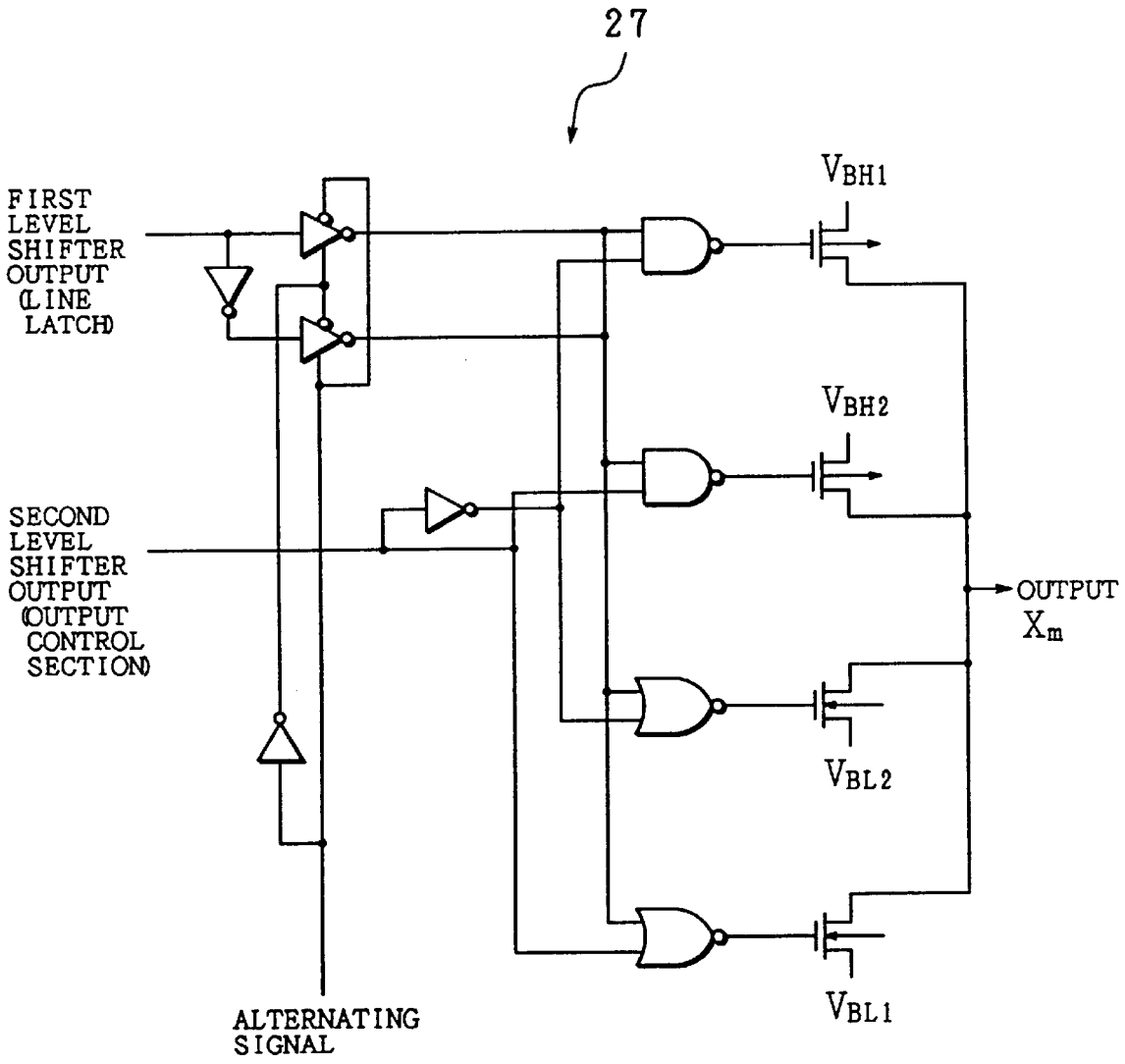
FIG. 4 is a logic circuit diagram associated with a liquid crystal driving circuit of the segment side driving circuit.

FIG. 4 shows an example of the structure of one output circuit of the liquid crystal driving output circuit 27 of FIG. 2 and FIG. 3. To an output $X_m$ are connected drains of P-channel MOS transistors whose source electrodes are respectively connected to $V_{BH1}$ and $V_{BH2}$, which are OFF•ON voltage levels, respectively, and drains of N-channel MOS transistors whose source electrodes are respectively connected to $V_{BL1}$ and $V_{BL2}$ which are ON•OFF voltage levels, respectively.

To the gate electrodes of the P-channel MOS transistor and the N-channel MOS transistor are inputted the output of the line latch 23, the output of the output control section 24, and the alternating signal via a logic circuit constituted by the NAND circuit, the NOR circuit, the inverter circuit, and the clocked inverter circuit. Table 1 is a truth table which shows the operation of this logic circuit.

TABLE 1

| Line Latch Output | Output Control Section Output | Alternating signal | Output $X_m$ |
|---|---|---|---|
| L | L | L | $V_{BH1}$ |
| H | L | L | $V_{BL1}$ |
| L | H | L | $V_{BH2}$ |
| H | H | L | $V_{BL2}$ |
| L | L | H | $V_{BL1}$ |
| H | L | H | $V_{BH1}$ |
| L | H | H | $V_{BL2}$ |
| H | H | H | $V_{BH2}$ |

Figure 5:
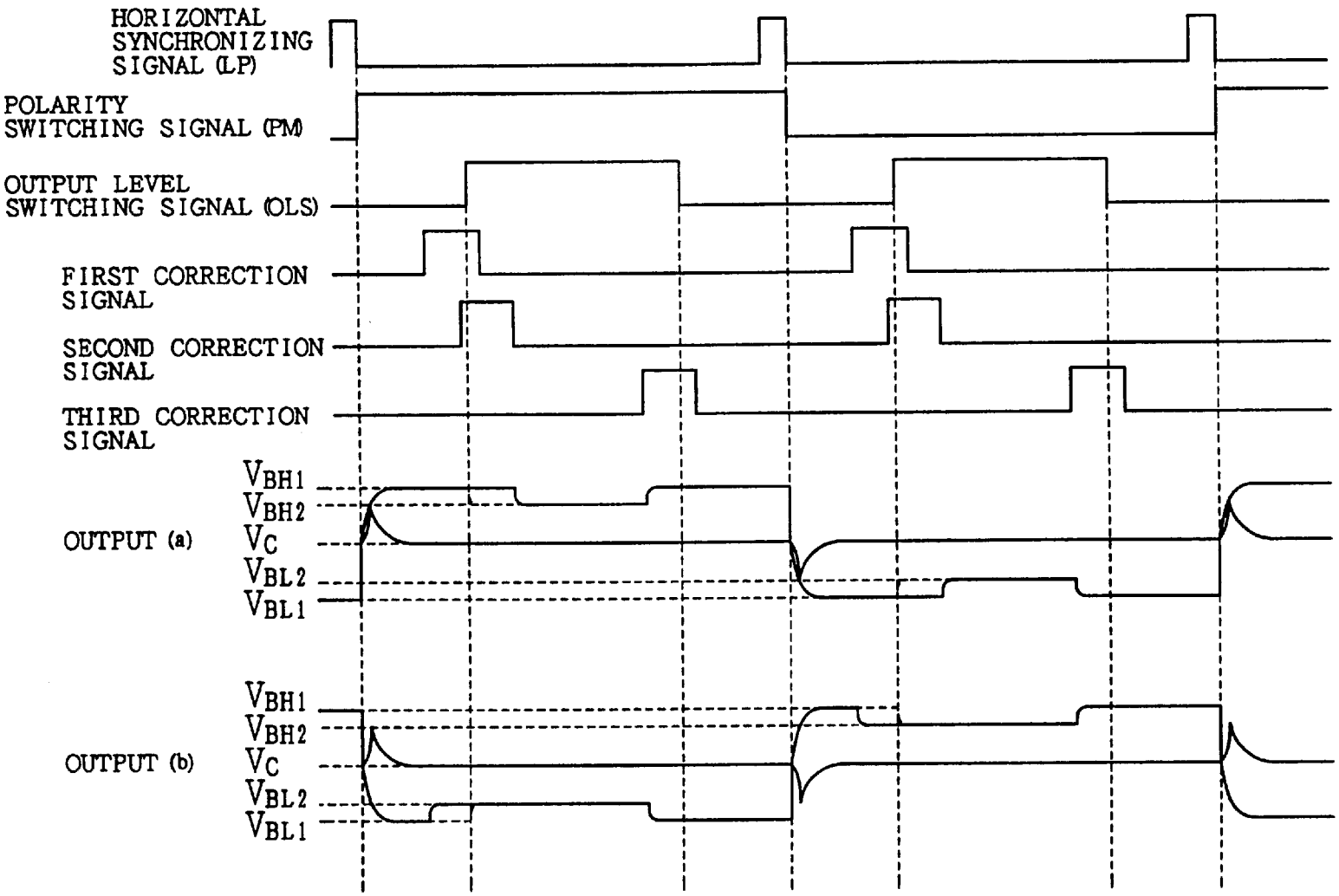
FIG. 5 is a timing chart showing an operation of the output control section.

FIG. 5 is a timing chart which shows the operation of the embodiment described referring to FIG. 3 and FIG. 4. In the present embodiment, the controller 5 sends the output level switching signal (OLS), the polarity switching signal (PM), and the first through third correction signals to the segment side driving circuit 2. In the present embodiment, the OLS signal once become "H" level in one scanning period. Also, in the present embodiment, the correction for luminous non-uniformity generated due to distortion of the common electrodes 12 is carried out by the first and second correction signals, and the PM signal outputted from the controller 5 becomes "H" level when the polarity of the distortion of the common electrodes 12 is on the side of $V_{BH}$, and becomes "L" level when the polarity thereof is on the side of $V_{BL}$.

As shown by output (a) in FIG. 5, when the polarity of the output level of the segment output, which is a data signal from the segment side driving circuit 2, and the polarity of the distortion of the common electrodes 12 are the same, the driving voltage applied to the liquid crystal cell 13 as shown in FIG. 1 is the difference between the common electrodes 12 and the segment electrodes 11, and for this reason the voltage corresponding to the distortion of the common electrodes 12 is lost as a driving voltage error. This voltage loss can be compensated for using the second correction signal, by adjusting the transition point at which the output level switches from $V_{BH1}$ level to $V_{BH2}$ level (from $V_{BL1}$ to $V_{BL2}$), that is, by adjusting the correction time, thus reducing luminous non-uniformity caused by an error in effective voltage due to distortion of the common electrodes 12.

As shown by output (b) in FIG. 5, when the polarity of the output level of the segment side driving circuit 2 and the polarity of the distortion of the common electrodes 12 are of opposite polarity, the driving voltage applied to the liquid crystal cell is the difference of the common electrodes 12 and the segment electrodes 11, and for this reason the voltage corresponding to the distortion of the common electrodes 12 is increased. This increased voltage, i.e., a driving voltage error, can be eliminated using the first correction signal, by adjusting the transition point at which the output level changes from $V_{BH1}$ to $V_{BH2}$ (from $V_{BL1}$ to $V_{BL2}$), that is, by adjusting the correction time, thus reducing luminous non-uniformity caused by an error in effective voltage due to distortion of the common electrodes 12.

The distortion generated on the common electrodes 12 is changed depending on the number of times the voltage level of the segment electrodes 11 changes from $V_{BH}$ to $V_{BL}$ or from $V_{BL}$ to $V_{BH}$ in a unit time. The change in distortion of the common electrodes 12 can be taken care of by adjusting a pulse width of the first and second correction signals by performing an operation with the display data signal and the alternating signal on the side of the controller 5. For example, when there is no change in either of the alternating signal and the display data signal in a plurality of adjacent scanning periods, no distortion is generated on the common electrodes 12, and the first and second correction signals are set so that "H" data are not outputted from the controller 5.

Also, the correction for luminous non-uniformity generated due to blunting of the output waveform of the segment output as the display data signal is carried out by the third correction signal. First, as shown in FIG. 5, when the output level of the segment side driving circuit 2 changes, the output waveform is blunted. The driving voltage applied to the segment side driving circuit 13 is the difference between the voltage on the common electrodes 12 and the voltage on the segment electrodes 11, and for this reason the voltage corresponding to the blunted waveform is lost.

To correct this voltage loss, the display data signal of a preceding scanning period is maintained in the D-flip-flop circuit 24*a* of the output control section 24 as shown in FIG. 3, and the display data signal thus maintained and the display data signal to be outputted are compared, and the third correction signal is made effective only when the two display data signals are different so as to adjust the transition point, i.e., correction time, at which the output level changes from $V_{BH2}$ level to $V_{BH1}$ level (from $V_{BL2}$ level to $V_{BL1}$)

As a result, with the described arrangement, the voltage loss is compensated for and it is possible to reduce luminous non-uniformity caused by an error in effective voltage due to blunting of an output waveform of the segment output as the display data signal.

In the present embodiment, the explanation was given through the case where the distortion correction of the common electrodes 12 and the blunting correction of the segment output waveform are both maintained. However, it is equally easy to maintain only one of the corrections.

FIG. 6, FIG. 7, FIG. 8, and FIG. 9 in accordance with the present embodiment show output waveforms from the driving circuits 2 and 3 and the driving waveform applied to the liquid crystal cell 13 when the display is a whole screen ON display, whole screen OFF display, stripe display, and block display, respectively. In all driving waveforms, the effective voltage error generated by a change in display data signal and a change in alternating signal is corrected, thus reducing luminous non-uniformity with respect to all the display patterns of the display data signal.

As described, in the present invention, there is provided a correction time (changing time) by the segment side driving circuit 2 for changing the output level to be ON display level within a range of a voltage level in the same polarity direction as the applied polarity direction of the output from the facing common electrodes 12 at least once in a single scanning period, and by adjusting the changing timing of the output level by the first through third correction signals inputted from the controller 5, the distortion generated on the common electrodes 12 by a change in output level of the segment side driving circuit 2 can be corrected, or a loss or increase in effective voltage, induced by blunted waveform, etc., of the output level, etc., generated by a difference in display pattern can be compensated for or eliminated, respectively. As a result, luminous non-uniformity due to a difference in display pattern can be reduced.

Also, in the present invention, the correction is not carried out when the output voltage of the segment side driving circuit 2 is not changed by the display data signal and the alternating signal, or when no distortion is generated on the common electrodes 12, thus realizing driving with a near-ideal waveform, which has been corrected as required. Thus, a maximum contrast is obtained on the display of the liquid crystal panel 1 and luminous non-uniformity can be suppressed.

Further, with the present invention, by carrying out correction as required, it is possible to reduce the difference between the effective voltage value by a driving waveform without correction and the effective voltage value by a driving waveform with correction, thereby reducing luminous non-uniformity further effectively.

Furthermore, in the present invention, the distortion expected to be generated on the common electrodes 12 and the blunted waveform are corrected by a change in the output level switching signal based on the horizontal synchronizing signal and by the first through third correction signals which can be easily generated based on a change in the alternating signal. This correction, that is, the changing period for changing the output level of the segment driving signal can be controlled by switching the voltages of four values based on a change in a driving signal corresponding to the display data signal, and based on a change in the alternating signal.

As a result, in the present invention, the distortion and blunted waveform can be corrected with a simple arrangement. Thus, an increase in cost can be suppressed by the simple arrangement while reducing the luminous non-uniformity further effectively compared with the arrangements and methods of Japanese Unexamined Patent Publication No. 116056/1998 (Tokukaihei 10-116056) and No. 12030/1994 (Tokukaihei 6-12030), which are the prior art given above, taken individually or in combination.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A driving device of a liquid crystal display device, comprising:

a group of signal electrodes which are driven by a driving signal that is in accordance with the display data;

a group of scanning electrodes which are disposed so as to intersect with said group of signal electrodes;

a liquid crystal sandwiched between said group of signal electrodes and said group of scanning electrodes;

alternate control means for alternately and inversely driving said liquid crystal by an alternating signal; and period control means for setting a changing period of a variable length for changing an output level of the driving signal at least once in a single scanning period, and for controlling the length of the changing period based on a change in the driving signal and a change in the alternating signal.

2. The driving device of a liquid crystal display device as set forth in claim 1, wherein:

said period control means includes signal generating means for generating (a) a polarity switching signal which is switched based on the display data and the alternating signal, (b) an output level switching signal in synchronization with a horizontal synchronizing signal, which is switched twice in one period of the horizontal synchronizing signal, and (c) a first correction signal and a second correction signal, which are different from each other and based on a switching timing of the polarity switching signal and a first switching timing of the output level switching signal, said period control means controlling the length of the changing period using the first correction and the second correction signal.

3. The driving device of a liquid crystal display device as set forth in claim 1, wherein:

said period control means includes signal generating means for generating (a) an output level switching signal in synchronization with a horizontal synchronizing signal, which is switched twice in one period of the horizontal synchronizing signal, and (b) a correction signal which is based on a second switching timing of the output level switching signal, said period control means controlling the length of the changing period using the correction signal.

4. The driving device of a liquid crystal display device as set forth in claim 1, wherein the driving signal is a pulse, and the changing period is set between a rise and a fall of the driving signal.

5. The driving device of a liquid crystal display device as set forth in claim 1, comprising:

a power source circuit for supplying (a) $V_C$ which is a non-select output level supplied to said group of scanning electrodes during a non-select period, and (b) $V_{BH1}$, $V_{BH2}$, $V_{BL2}$, and $V_{BL1}$, which are output levels of the driving signal, supplied to said group of signal electrodes, satisfying a relationship of $V_{BH1}>V_{BH2}>V_C>V_{BL2}>V_{BL1}$.

6. The driving device of a liquid crystal display device as set forth in claim 5, wherein said period control means outputs $V_{BH2}$ or $V_{BL2}$ with respect to said group of signal electrodes in the changing period, and outputs $V_{BH1}$ or $V_{BL1}$ with respect to said group of signal electrodes in a non-changing period.

7. A method for driving a liquid crystal display device for driving a liquid crystal sandwiched between a group of signal electrodes and a group of scanning electrodes which are disposed to intersect with the group of signal electrodes, by a driving potential difference between the group of signal electrodes and the group of scanning electrodes facing each other, said method comprising the steps of:

(1) providing in a driving signal of the group of signal electrodes a changing period of a variable length for changing an output level of the driving signal at least once in a single scanning period;

(2) controlling the length of the changing period based on a change in the driving signal and a change in an alternating signal; and (3) correcting, by the control of the length of the changing period, a driving voltage error generated by distortion which is generated on the group of scanning electrodes by the driving signal of the group of signal electrodes.

8. A method for driving a liquid crystal display device for driving a liquid crystal sandwiched between a group of signal electrodes which are driven by a driving signal in accordance with display data and a group of scanning electrodes which are disposed to intersect with the group of signal electrodes, said method comprising the steps of:

(1) comparing display data and display data of a preceding scanning period in a signal electrode group side driving circuit which drives the group of signal electrodes; and (2) correcting, when there is a difference between the display data compared in said step (1), a driving voltage error generated by blunted waveform of the driving signal, by controlling a variable length of a changing period for changing an output level of the driving signal in a single scanning period.

9. The method as set forth in claim 8, wherein:

the liquid crystal is inversely driven by an alternating signal, and when the display data compared are different while the alternating signal is not inverted, the driving voltage error generated by blunted waveform of the driving signal is corrected by controlling the length of the changing period.

10. A method for driving a liquid crystal display device for alternately and inversely driving by an alternating signal a liquid crystal sandwiched between a group of signal electrodes which are driven by a driving signal in accordance with display data and a group of scanning electrodes which are disposed to intersect with the group of signal electrodes, said method comprising the steps of:

(1) comparing display data and display data of a preceding scanning period in a signal electrode group side driving circuit which drives the group of signal electrodes; and (2) correcting, when the alternating signal has been inverted and when the display data compared in said step (1) are the same, or when the alternating signal has not been inverted and when the display data compared in said step (1) are different, a driving voltage error generated by blunted waveform of the driving signal, by controlling a variable length of a changing period for changing an output level of the driving signal in a single scanning period.

11. A method for driving a liquid crystal display device for driving a liquid crystal sandwiched between a group of signal electrodes and a group of scanning electrodes which are disposed to intersect with the group of signal electrodes, the liquid crystal being driven by a driving signal in accordance with display data, which is outputted to the group of signal electrodes, and by a scanning signal outputted to the group of scanning electrodes, said method comprising the step of:

setting a changing period for changing an output level of the driving signal in a single scanning period so as to control a start timing of the changing period based on the display data and an inverse driving state and thereby changes a length of the changing period to change the output level of the driving signal.

12. A method for driving a liquid crystal display device for driving a liquid crystal sandwiched between a group of signal electrodes and a group of scanning electrodes which are disposed to intersect with the group of signal electrodes, the liquid crystal being driven by a driving signal in accordance with display data, which is outputted to the group of signal electrodes, and by a scanning signal outputted to the group of scanning electrodes, said method comprising the step of:

setting a changing period for changing an output level of the driving signal in a single scanning period so as to control an end timing of the changing period based on the display data and an inverse driving state and thereby changes a length of the changing period to change the output level of the driving signal.

13. The driving device of a liquid crystal display device as set forth in claim 1, wherein said period control means changes a start timing or an end timing of the changing period so as to control the length of the changing period.

14. The method for driving a liquid crystal display device as set forth in claim 7, wherein a start timing or an end timing of the changing period is changed to control the length of the changing period and thereby control an output level of the driving signal, so as to correct the driving voltage error.

15. The method for driving a liquid crystal display device as set forth in claim 8, wherein a start timing or an end timing of the changing period is changed to control the length of the changing period and thereby control an output level of the driving signal, so as to correct the driving voltage error.

16. The method for driving a liquid crystal display device as set forth in claim 10, wherein a start timing or an end timing of the changing period is changed to control the length of the changing period and thereby control an output level of the driving signal, so as to correct the driving voltage error.

17. The driving device of a liquid crystal display device as set forth in claim 6, comprising:

signal generating means for generating a polarity switching signal which outputs a high level and a low level respectively when the driving signal corresponding to the display data becomes High level and Low level according to the alternating signal, wherein said period control means extends the length of the changing period when a result of exclusive OR operating on the display data, the alternating signal, and the polarity switching signal is at High level, and said period control means shortens the length of the changing period when a result of said exclusive OR is at Low level.

18. The driving device of a liquid crystal display device as set forth in claim 6, comprising:

comparing means for comparing the driving signal with a driving signal of a preceding scanning period, wherein said period control means shortens the length of the changing period when the driving signals compared by said comparing means are different and when the alternating signal has not been inverted, or when the driving signals compared by said comparing means are the same and when the alternating signal has been inverted.

19. The method for driving a liquid crystal display device as set forth in claim 7, wherein:

the driving signal has high level outputs $V_{BH1}$ and $V_{BH2}$ and low level outputs $V_{BL1}$ and $V_{BL2}$ which are related by $V_{BH1}>V_{BH2}>V_{BL2}>V_{BL1}$, and the output level of the driving signal becomes $V_{BH2}$ or $V_{BL2}$ in the changing period, and becomes $V_{BH1}$ or $V_{BL1}$ in a non-changing period, and the length of the changing period is varied depending on a result of exclusive OR operating on the display data, the alternating signal, and a signal which becomes High level and Low level respectively when the driving signal corresponding to the display data becomes High level and Low level according to the alternating signal, so that the length of the changing period becomes longer when the result of exclusive OR is at High level and becomes shorter when the result of exclusive OR is at Low level.

20. The method for driving a liquid crystal display device as set forth in claim 8, wherein:

the driving signal has high level outputs $V_{BH1}$ and $V_{BH2}$ and low level outputs $V_{BL1}$ and $V_{BL2}$ which are related by $V_{BH1}>V_{BH2}>V_{BL2}>V_{BL1}$, and the output level of the driving signal becomes $V_{BH2}$ or $V_{BL2}$ in the changing period, and becomes $V_{BH1}$ or $V_{BL1}$ in a non-changing period, and the length of the changing period is made shorter when the display data compared are different.

21. The method for driving a liquid crystal display device as set forth in claim 10, wherein:

the driving signal has high level outputs $V_{BH1}$ and $V_{BH2}$ and low level outputs $V_{BL1}$ and $V_{BL2}$ which are related by $V_{BH1}>V_{BH2}>V_{BL2}>V_{BL1}$, and the output level of the driving signal becomes $V_{BH2}$ or $V_{BL2}$ in the changing period, and becomes $V_{BH1}$ or $V_{BL1}$ in a non-changing period, and the length of the changing period is made shorter when the alternating signal has been inverted and when the display data compared are the same, or when the alternating signal has not been inverted and when the display data compared are different.

* * * * *